United States Patent [19]

Stoudt et al.

[11] Patent Number: 4,794,421

[45] **Date of Patent: * Dec. 27, 1988**

[54] APPARATUS AND METHOD FOR ELECTROPHOTOGRAPHICALLY PRODUCING COPIES FROM ORIGINALS HAVING CONTINUOUS-TONE AND OTHER CONTENT

[75] Inventors: Michael D. Stoudt, Webster; Michael Mosehauer, Rochester; Eric K. Zeise, Pittsford; Jerome G. Spitzner, deceased, late of Rochester, by Nona V. Spitzner, administratrix; David Q. McDowell, Penfield; George N. Tsilibes, Rochester, all of N.Y.

[73] Assignee: Eastman Kodak Company, Rochester, N.Y.

[ * ] Notice: The portion of the term of this patent subsequent to Sep. 18, 2001 has been disclaimed.

[21] Appl. No.: 809,550

[22] Filed: Dec. 16, 1985

Related U.S. Application Data

[60] Continuation-in-part of Ser. No. 746,218, Jun. 18, 1985, abandoned, which is a continuation of Ser. No. 617,047, Jun. 4, 1984, Pat. No. 4,537,490, which is a division of Ser. No. 493,868, May 12, 1983, Pat. No. 4,472,047.

[51] Int. Cl.[4] ..... G03G 15/01; G03G 15/04

[52] U.S. Cl. ..... 355/3 R; 355/4; 355/7; 430/31; 430/42

[58] Field of Search ..... 355/3 R, 4, 7, 11, 14 E, 355/77, 40, 41; 430/31, 42, 44, 54, 43; 367/907

[56] References Cited

U.S. PATENT DOCUMENTS

| | | |
|---|---|---|
| 2,605,181 | 7/1952 | Alexander et al. . |
| 2,665,984 | 1/1954 | Le Tourneau et al. . |
| 3,439,983 | 4/1969 | Blow, Jr. . |
| 3,523,725 | 8/1970 | Schaeffer . |
| 3,576,367 | 4/1971 | Sable . |
| 3,620,618 | 11/1971 | White . |
| 3,724,943 | 4/1973 | Draugelis et al. . |
| 3,728,018 | 4/1973 | Wharton et al. . |
| 3,825,338 | 7/1974 | Kolibas . |

(List continued on next page.)

FOREIGN PATENT DOCUMENTS

| | | | |
|---|---|---|---|
| 3035731 | 4/1981 | Fed. Rep. of Germany . | |
| 2266198 | 10/1975 | France . | |
| 57-48860 | 3/1982 | Japan . | |
| 57-119379 | 7/1982 | Japan . | |
| 58-43482 | 3/1983 | Japan . | |
| 59-87470 | 5/1984 | Japan . | |
| 59-93459 | 5/1984 | Japan . | |
| 60-166969 | 8/1985 | Japan | 355/4 |
| 2123647 | 2/1984 | United Kingdom . | |

OTHER PUBLICATIONS

Japanese Patent Abstract 59-88757, 5/22/84.
Japanese Patent Abstract 59-88758, 5/22/84.
Japanese Patent Abstract 60-208747, 10/21/85.
IBM Technical Disclosure Bulletin, vol. 28, No. 6, Nov. 1985, Half Toning Adjacent to Graphics.

*Primary Examiner*—Arthur T. Grimley
*Assistant Examiner*—J. Pendegrass
*Attorney, Agent, or Firm*—Norman Rushefsky

[57] ABSTRACT

Apparatus and method for electrophotographically producing high quality reproductions which contain different content types. Photoconductor image sectors are subjected to separate optical exposures selected for (1) good tone-scale reproduction of continuous-tone image portions and (2) high-contrast reproduction of line-type image portions. Photoconductor background area, which border continuous-tone image portions, are discharged to a level below the system's development level. Color line-art from a black and white original is also provided for in a color-copier by exposing a separate original containing a swatch of the color to be reproduced on the same image frames exposed to the image of the line-art. A digitizing tablet is used in combination with a selective erase means to provide selective screening and/or spot color effects. The digitizing tablet may be incorporated to use the exposure platen and may be of the sonic type or other types not employing grid lines visible to the photoconductor.

56 Claims, 9 Drawing Sheets

U.S. PATENT DOCUMENTS 3,970,042 7/1976 Rees .
4,027,962 6/1977 Mailloux et al. .
4,043,656 8/1977 Cherian .
4,045,218 8/1977 McVeigh .
4,066,351 1/1978 Kidd .
4,083,632 4/1978 Mailloux et al. .
4,111,542 9/1978 Mailloux et al. .
4,256,820 3/1981 Landa .
4,294,536 10/1981 Paxton .
4,403,257 9/1983 Hsieh .
4,412,805 11/1983 Morrison .
4,527,886 7/1985 Inamori et al. .
4,655,580 4/1987 Watanabe et al. ..... 355/7
4,679,927 7/1987 Sogo et al. ..... 355/14 EY
4,685,794 8/1987 Watanabe ..... 355/7

APPARATUS AND METHOD FOR ELECTROPHOTOGRAPHICALLY PRODUCING COPIES FROM ORIGINALS HAVING CONTINUOUS-TONE AND OTHER CONTENT

CROSS-REFERENCE TO RELATED APPLICATIONS

This is a continuation-in-part application of U.S. Application Ser. No. 746,218, filed on June 18, 1985 in the name of Michael D. Stoudt and now abandoned, which in turn is a continuation of U.S. Application Ser. No. 617,047, filed June 4, 1984 and now U.S. Pat. No. 4,537,490, which in turn is a division of U.S. Application Ser. No. 493,868, filed May 12, 1983, now U.S. Pat. No. 4,472,047.

BACKGROUND OF THE INVENTION

1. Field of the Invention

The present invention relates to electrophotographic reproduction methods and apparatus and more specifically to the improved production of copy (including black-and-white and color reproductions) of the kind having both continuous-tone (e.g. pictorial) and other (e.g. line-type) content.

2. Brief Description of the Prior Art

As the development and use of electrophotography continues to advance, one continuing goal is to improve the quality of electrophotographic reproductions which contain different types of information content such as continuous-tone content, line-type content and uniform background content. Various problems make attainment of this goal a technical challenge. For example, procedures which tend to optimize reproduction of line-type information (for example, alphanumerics) are not optimal for reproduction of continuous-tone information (for example photographs, paintings, etc). The problems only worsen when it is desired to make such high quality reproductions in automated equipment that is capable of continuous mode operation and good productivity. The accommodation of color information, as well as black-and-white information, poses even further problems.

A wide variety of electrophotographic techniques and equipment approaches have been suggested to meet one or more of the problems outlined above; however, there is considerable desire for further improvement.

SUMMARY OF THE INVENTION

One important purpose of the present invention is to provide improved apparatus and techniques for coping with the problems, such as outlined above, that arise in electrophotographically producing high quality reproductions containing such different types of information content. A variety of advantages pertain to the different aspects of the invention, which are described in more detail below. For example, significant advantages exist in regard to the flexibility, simplicity and speed with which high quality reproductions can be produced in accord with the present invention.

The present invention provides an electrophotographic method and apparatus for producing a reproduttion having a composite image of screened image areas of pictorial information and unscreened areas with line-type information wherein (a) each of two image sectors or frames of a photoconductor are electrostatically charged; (b) an electrostatic screened image of pictorial information is formed onto on image sector by reflection or transmission exposure of an original having the pictorial information as a continuous tone image; (c) background areas of the said one image sector frame which border the pictorial information exposure are erased using a means, such as an illumination source, separate from that used in step (b); (d) on a second image frame an electrostatic unscreened image of line-type information is formed by means providing line-type information; (e) the respective images on the two image frames are developed; and (f) the developed images are transferred from respective image frames in register onto a copy sheet to produce the reproduction having the composite image thereon.

The invention is further directed to methods and apparatus for providing reproductions in colors different from that of an original.

In further aspects the present invention provides structural configurations for producing electrophotographic images according to the above-described and equivalent methods in a highly productive continuous mode of operation.

BRIEF DESCRIPTION OF THE DRAWINGS

The subsequent description of preferred embodiments of the present invention refers to the attached drawings wherein.

DETAILED DESCRIPTION OF THE PREFERRED EMBODIMENTS

Because electrophotographic reproduction apparatus are well known, the present description will be directed in particular to elements forming part of or cooperating more directly with the present invention. Apparatus not specifically shown or described herein are selectable from those known in the prior art.

Figure 1:
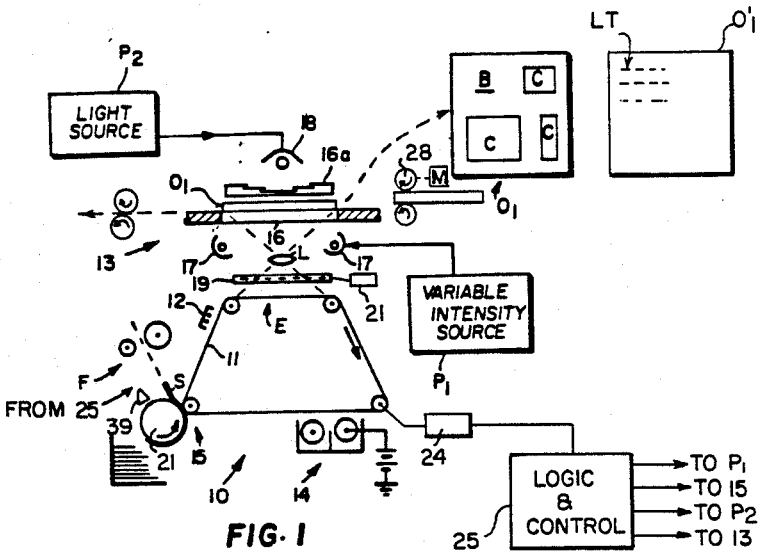
FIG. 1 is a schematic side view of one embodiment of electrophotographic apparatus for practice of the present invention.

Referring now to FIG. 1, there is shown an apparatus 10 which is adapted, in accord wihh one aspect of the present invention, to produce electrophotographic reproductions of documents including screened image areas such as of pictorials and surrounding white (or low-density) background border zones with unscreened line-type information. One advantageous feature of the FIG. 1 structure and technique is its capability to produce good tone-scale (particularly in difficult highlight portions) together with backgrounds which are "substantially clean" (i.e. do not have an objectionable density level). The apparatus 10 includes a photoconductor 11 (e.g. a belt comprising a photoconductive insulator layer overlying a conductive layer on a support) having one or more image sectors or frames adapted for movement along an operative path past primary charging station 12, exposure station 13, development station 14 and transfer station 15. The corona charger at station 12, magnetic brushes at station 14 and transfer roller at station 15 can be of the various types known in the art and equivalent devices can be utilized. The inventive structural and procedural aspects of the FIG. 1 embodiment of the invention pertain to exposure station 13.

The exposure procedure and structure of the present invention involve provision and use of an original of predetermined format. Specifically, the original $O_1$ comprises a light reflective continuous-tone area(s) C formed within a light-transmissive background area B. One preferred embodiment comprises photographic prints mounted on a light-transmissive plastic support. In accord with the present invention the exposure station 13 includes means for supporting original $O_1$ (e.g. transparent platen 16) at the illumination zone of apparatus 10, a first illumination source 17 located between the illumination zone and the photoconductor 11 and second illumination source 18 located on the opposite side of the illumination zone from photoconductor 11. Lens means L is provided to image the original at the illumination zone onto the photoconductor 11 at exposure zone E and a Fresnel-type field lens element 16*a* images the transmission source 18 on the lens L. (If the background area B is diffuse, lens 16*a* can be omitted; however, the source 18 should be of a higher intensity.) A particularly preferred embodiment includes a half-tone screen 19 located in the optical path of lens L and proximate the exposure zone.

In operation, a photoconductor image sector is moved past the charging station 12, where it receives a uniform primary electrostatic charge, and into exposure zone E. At this stage illumination sources 17 and 18 are actuated to illuminate the original $O_1$ (which is in place on platenll6 with its light-reflective, continuous-tone portions facing the exposure zone E). More particularly, sources 17, e.g. xenon flash lamps are energized by power source $P_1$ at an intensity level selected for optimizing tone-scale of the electrostatic latent image formed on the photoconductor by light reflected from the continuous-tone portions C. The light source 18, e.g. a xenon flash lamp, is energized by its power source $P_2$ to provide an exposure level at the photoconductor which substantially discharges portions of the photoconductor (corresponding to background B) by transmission exposure. That is, the intensity of this transmission exposure is selected to reduce the electrostatic charge level of portions corresponding to document background below the development level of the apparatus (e.g. to a level proximate or below the bias on magnetic brushes at development station 14). The discharge of transmission-exposed photoconductor portions therefore is preferably more than the maximum discharge (minimum development density level) of the reflection-exposed portions. When screen 19 is present, the exposure from source 18 is selected to discharge the screen pattern in the background areas below the development level of the apparatus. The electrostatic image is then developed at 14, and the resulting toner image is transferred to copy sheet S and fixed at fusing station F. Thus, in accord with the present invention, continuous-tone photoconductor regions can be exposed at one of a plurality of preselectable levels (chosen to optimize tone-scale of the electrostatic image) and such continuous-tone exposure need not be concerned with the need for complete discharge in document background areas. This allows substantial improvement in the quality of electrophotographic reproductions of images which contain different content types like $O_1$.

As will be readily appreciated by those skilled in the art, the level of photoconductor exposure of the continuous-tone images can be varied in ways other than adjustment of the illumination intensity of source $P_1$, e.g. such as by aperture adjustment and/or illumination time control. Similarly one skilled in the art may readily substitute other exposure techniques, e.g. scan exposure techniques, for the flash exposure system described with respect to FIG. 1. In certain applications the portions B of original $O_1$ may desirably be selectively light-transmissive, light diffusive and/or contain opaque line-type information. Also, if desired a graphic transparency image can be overlaid in a desired register with the original $O_1$, e.g. in register with a portion of background B.

In a modification of the apparatus and method described above for FIG. 1, the continuous tone and line-type information may be located on different originals $O_1$ and $O'_1$ and which will be located in the exposure station 13 at different times. A document positioner 28, schematically shown as a roller drive, locates the document $O_1$ in the exposure station 13. A logic and control unit 25, at a suitable time determined by a program stored therein and based on signals provided by photoconductor image sector location detector 24, initiates an exposure on a first image sector by sources 17 and 18 to provide an electrostatic screened image exposure of the continuous tone portions C and to (as described above) substantially discharge areas in this image sector corresponding to background portions B of $O_1$ to a charge level below the development level. The document positioner 28 then drives $O_1$ from the exposure station and feeds original document sheet $O'_1$ into position for exposure. Document $O'_1$ may be a highly reflective support such as white paper which includes line-type information LT in areas corresponding to tha background areas B of original document sheet $O_1$. When $O'_1$ is in the exposure station 13 screen 19 is withdrawn or otherwise located out of the exposure light path by a solenoid operated mechanism 21 in response to a signal from logic and control unit 25. At an appropriate time determined by logic and control 25 based on signals provided by photoconductor image sector location detector 24, light sources 17 are illuminated to expose the line-type information LT on a second or different image sector or frame. No illumination from lamp 18 is used for the exposure on the second image sector. The electrostatic latent image on the first image sector is developed by development station 14. At transfer station 15, which is schematically shown, the copy sheet S is brought into registered engagement with the developed first image frame of the photoconductor to transfer the image to the copy sheet in a registered relationship based on timing signals provided by detector 24. A charged transfer roller 21 may be provieed to attract the image to the copy sheet and to remove the copy sheet from engagement with the photoconductor with the transferred image retained on the copy sheet. The roller may then be driven again so that the copy sheet S may be once again moved into registered relationship with photoconductor 11. On this occasion the same surface of the copy sheet is registered with the second image frame to transfer that image to the copy sheet and a detack or stripper device 39 is operated to move the copy sheet with the composite images registered thereon to fusing station F. The composite image produced comprises areas of pictorial information that are screened because they are derived from a screened exposure of continuous tone information on the original and areas of line-type information which are unscreened because the exposure of this information has not been modulated by a screen.

The exposures of each image sector may be adjusted to optimize the exposure for the type of information reproduced on that sector. Furthermore, the use of illumination source 18 which is independent of illumination source 17 to expose the background areas on the first image sector also permits for optimization of illumination source 17 for exposure of pictorial type information as described above.

Figure 2:
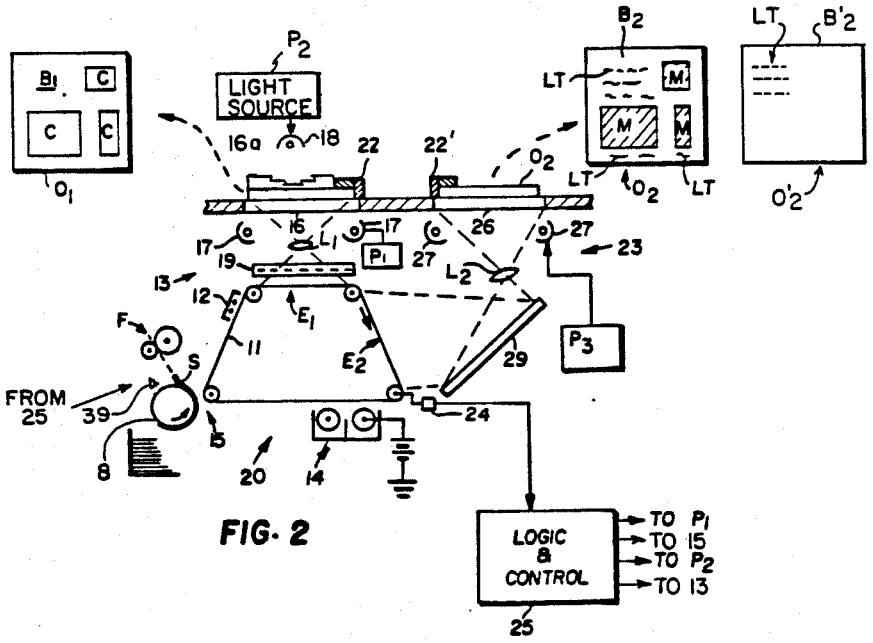
FIG. 2 is a schematic side view of another embodiment of electrophotographic apparatus for practice of the present invention.

Referring now to FIG. 2, the apparatus 20 is adapted, in accordance with the present invention, to produce electrophotographic reproductions having screened, continuous-tone image areas of excellent tone-scale, "substantially clean" background areas and unscreened line-type information areas with high contrast. In this embodiment first and second component-originals $O_1$ and $O_2$ are employed to form a composite reproduction. Much of the structure of apparatus 20 can be the same as described with respect to FIG. 1, and such common structure is indicated with corresponding designators in FIG. 2. The additional structure of the apparatus 20 in general comprises a second exposure station 23 constructed to expose a second component original $O_2$ at a second exposure zone $E_2$. Positioning structure 22 and 22' is provided respectively at exposure stations 13 and 23 to accurately locate originals on the exposure platens. A photoconductor sector or frame location detector or encoder 24 and logic and control unit 25 are provided to coordinate exposure of component original $O_2$ in register on a common photoconductor image sector with the electrostatic image of a first component original $O_1$ (previously exposed on that photoconductor sector at station $E_1$). Illumination source 18 of the FIG. 1 embodiment is not employed in the FIG. 2 embodiment now being described.

Station 23 includes a light-transmissive document platen 26, illumination sources 27 (e.g. xenon flash lamps) coupled to a power source $P_3$, mirror 29 and lens means $L_2$ for imaging a component original $O_2$ at exposure zone $E_2$. The component original $O_2$ is predeterminedly constructed to cooperate with original component $O_1$, and for this purpose $O_2$ has mask portions M which prevent source 27 illumination from passing to predetermine portions of exposure zone $E_2$ (viz. those portions which correspond to portions C of the original $O_1$). In embodiments where sources 27 are located to reflectively illuminate component original $O_2$, the portions M can be light-absorptive (e.g. black) or light-transmissive. In such an embodiment, the background portions $B_2$ of component original $O_2$ are desirably highly light reflective (e.g. white) and line-type portions LT are light-absorptive (e.g. black). If desired the illumination sources 27 can be on the oppssite side of platen 26 from exposure zone $E_2$ and in such an embodiment the component original $O_2$ can have light-reflective or opaque mask portions M, light-transmissive background portions $B_2$ and light-blocking line-type portions LT (e.g. black, light-reflective or light-scattering alphanumerics). As will be understood by those skilled in the art, the background portions $B_1$ of component original $O_1$ can be light-absorptive rather than light-transmissive. The desired function is to mask (e.g. be non-reflective to) source 17 light and thus prevent it from passing to the photoconductor sector corresponding to portions $B_1$ of original $O_1$. A platen cover formed of light-absorptive material also could be used for this purpose.

In operation, a photoconductor image sector is primary-charged at station 12, transported to exposure zone $E_1$ and exposed to component original $O_1$ by sources 17 as previously described with respect to FIG. 1. This provides a screened electrostatic latent image of the desired tone-scale on photoconductor sector portions corresponding to continuous-tone information areas C of component original $O_1$. The uniform primary charge remains on portions of the photoconductor sector that correspond to background portions $B_1$ of original $O_1$. The photoconductor sector next moves to exposure zone $E_2$; and when it is in proper alignment with respect to exposure station 23 (as sensed by detector 24), logic and control unit 25 effects a high-contrast exposure of that photoconductor image sector to cooperative component original $O_2$. Thus sources 27 are energized and the photoconductor sector is exposed to $O_2$ via lens $L_2$ and mirror 29 at a high exposure level. This forms a high-contrast, non-screened image of line-type information areas LT and, in addition, discharges the photoconductor image sector portions corresponding to background areas $B_2$ (to a level below the develpment level of apparatus 20). The photoconductor image sector, which now baars the composite electrostatic image, is then developed by magnetic brushes at station 14 and the developed toner image is transferred to a copy sheet S at station 15 and fixed to the sheet at fusing station F.

In a modification of the apparatus and method described for FIG. 2, the exposure station 13 could be identical to that shown in FIG. 1. with the inclusion of source 18. In this modification exposures $E_1$ and $E_2$ would be on different image sectors or frames each of which have received a primary charge from charging station 12. The timing of these exposures would be controlled by logic and control unit 25 in response to signals from sector detector 24. The exposure of $O_1$ is made on a first image sector using sources 17 and 18 as described for the embodiment of FIG. 1. The exposure of an original similar to that of $O'_2$ shown is made by locating same on platen 26 and exposing a second image sector, using sources 27, to the line-type information LT which is in registered relationship with the background areas $B_1$ on original $O_1$. Original $O'_2$ like original $O_2$ has highly reflective (e.g. white) background areas $B'_2$ but unlike $O_2$ does not have mask portions since $O_1$ and $O'_2$ are exposing different image sectors. Thus, a screened electrostatic latent image of continuous tone or pictorial portions C is formed on the first image sector with background areas corresponding to $B_1$ having charge levels thereon reduced to below development. On the second image sector an electrostatic latent image of the line-type portion LT is provided with clear background areas corresponding to $B'_2$. Both image sectors have their respective latent electrostatic images serially developed in development station 14. Each image is transferred in register onto the same side of copy sheet, S, using charged vacuum roller 8 as described above for the modified FIG. 1 embodiment and the composite toner image is fused on the copy sheet at fuser station F. Thus, in this embodiment there is also provided a composite copy sheet reproduction of the images from different originals $O_1$ and $O'_2$ wherein the copy sheet has a screened image area of say pictorial information derived from the continuous tone original $O_1$ and unscreened line-type information derived from original $O'_2$. The background areas formed on the copy sheet will be substantially "clean" and not portray "mottle" which is usually a problem found in reflection exposure of white background areas on an original that is exposed when a screen is present. Also as described above, the exposures of pictorial and line-type information may be optimized for each.

Figure 3:
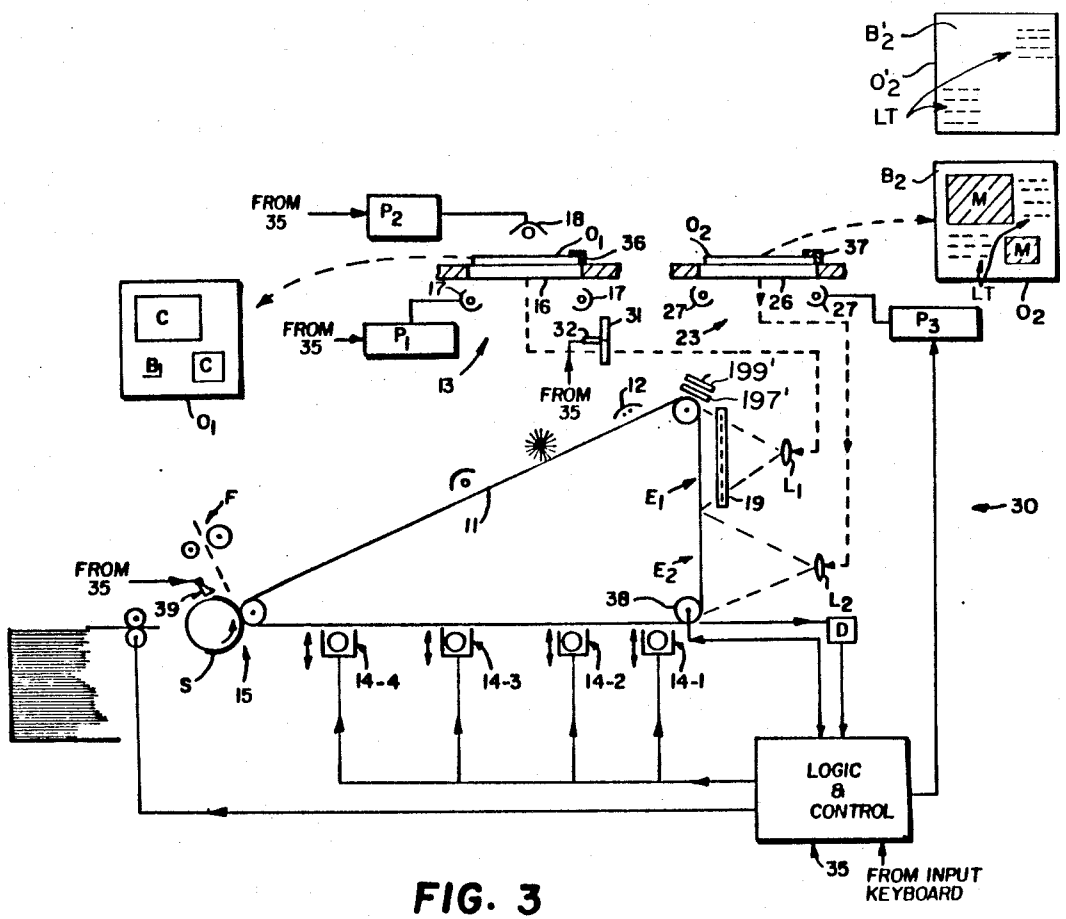
FIG. 3 is a schematic side view of another embodiment of electrophotographic apparatus for practice of the present invention.

Referring now to FIG. 3, apparatus 30 provides features and advantages such as previously described in an embodiment capable of producing color or black-and-white reproductions containing different information content types. The apparatus 30 provides reproductions wherein continuous-tone areas have good tone-scale, line-type information areas are of high contrast and background areas are "substantially clean" with respect to unwanted toner deposition. Again, much of the structure of the apparatus can be as previously described and such portions are indicated by designators corresponding to those of FIGS. 1 and 2.

There are significant differences between apparatus 30 and previously-described embodiments which provide additional capabilities e.g., in regard to reproducing color originals or black-and-white reproductions. In this regard an array 31 of color filters e.g. including red, green and blue filters, is mounted along the optical path of exposure station 13. The array 31 is indexable by shaft 32 to selectively position each particular color filter in the optical path during the successive color-separation exposures of continuous-tone portions C of a color original $O_1$. Also in the apparatus 30 embodiment, the development means 14 includes discrete magnetic brush devices 14-1, 14-2, 14-3, 14-4, which are operable, in response to signals from logic and control unit 35, to selectively apply different colors of toner (e.g. cyan, magenta, yellow and black toner) to different photoconductor image sectors. The functioning of these additional devices in cooperation with the other structure of electrophotographic apparatus 30 will be easily understood by considering the following operational descriptions of its different modes.

To commence operation of a color copy run, component originals $O_1$ and $O_2$ are prepared and positioned at predetermined positions respectively on platens 16 and 26. In the illustrated embodiment, component original $O_1$ comprises a plurality of color continuous-tone information areas C (e.g. color prints or pictorials) mounted on a light-transmissive support which forms background areas $B_1$. The component original $O_2$ for the FIG. 3 embodiment comprises a light-reflective (e.g. white) background $B_2$ with black mask areas M located in register with areas C of component original $O_1$ and with high-contrast, line-type information LT (e.g. black alphanumeric information) located in adjacent areas on the white support. Index or positioning means, e.g. guide rails 36, 37, are provided to assure proper relative location of the component originals and thus proper register of their light images at exposure stations $E_1$ and $E_2$. With the originals $O_1$ and $O_2$ thus prepared and positioned, the operator inputs control data to logic and control unit 35, e.g. by a keyboard (not shown). Such data can include: (1) the desired operational mode (color or black-and-white), (2) desired number of reproductions and (3) special exposure level information regarding the respective color-separation exposures of composite original $O_1$. With regard to the last-mentioned input data, the operator often will perform preruns of the color-separation exposures at varying levels to determine optimum exposure levels for the particular pictorial information involved. Logic and control unit 35 preferably contains memory to store selected exposure levels for each respective color-separation exposure.

When the above data is input, a "run" command is actuated by the operator, and the photoconductor belt 11 moves successive photoconductor image sectors thereof past primary charger 12 and onto exposure zone $E_1$. Position of the photoconductor image sectors is detected by a sensor, e.g. a detector D of perforations in the photoconductor, and a position signal is input to unit 35. Logic and control unit 35 effects control of successive red, green and blue color exposures onto successive photoconductor sectors. For example, such control from unit 35 can include synchronization of: (1) the indexing of filter array 31, (2) energization of power source $P_1$ at the desired level(s) and (3) energization of source $P_2$ to actuate background clean-up. The three photoconductor image sectors, thus exposed, respectively comprise screened, continuous-tone red, green and blue color-separation electrostatic images corresponding to portions C of the original $O_1$ and background portions discharged by source 18 to a level below the development level of apparatus 30 (e.g. below the bias level applied to the brushes of stations 14 by means not shown). As the sector bearing the red color-separation electrostatic image moves over magnetic brush 14-1, the brush is activated by unit 35 to apply cyan toner in accordance with the electrostatic image. Similarly brushes 14-2 and 14-3 are activated to apply magenta and yellow toner respectively to the subsequent green and blue electrostatic color-separation images on successive sectors of the photoconductor.

As a fourth primary-charged sector of the photoconductor belt 11 passes zone $E_1$, a panchromatic light exposure of selected tone-scale is effected by sources 17, without the activation of source 18. It may be preferred to filter this exposure, e.g. with another element of array 31, to achieve a more panchromatic system response for this exposure. At this stage, the electrostatic pattern on the fourth photoconductor image sector includes a screened, continuous-tone latent image pattern of the pictorial areas C and uniform primary charge on other areas corresponding to background $B_1$. The fourth sector moves next to exposure zone $E_2$, and, in proper timed relation with movement of belt 11, unit 35 activates sources 27 to effect a high-contrast exposure of component original $O_2$, in register with the image of component original $O_1$, onto the fourth sector. The electrostatic image on the fourth sector leaving zone $E_2$ thus comprises (1) the continuous-tone electrostatic image component exposed at zone $E_1$ (and undisturbed by the zone $E_2$ exposure because of mask portions M on original $O_2$), (2) the high-contrast, unscreened, alphanumeric electrostatic patterns corresponding to areas LT of composite original $O_2$ and (3) the clean background portions discharged below the development level. The fourth sector subsequently is developed with black toner by magnetic brush 14-4. It will be appreciated that logic and control unit 35 can be constructed to effect the above-described exposures of the four photoconductor image sectors in any desired sequence. Also, it will be appreciated that logic and control can effect exposures so that the line information is in a color(s) other than black. For example, cyan line information can be provided by omitting the source 18 illumination and providing source 27 illumination to the red filter exposed image sector rather than the neutral density exposed sector. Of course the apparatus 30 can employ less than four colors, if desired.

After exposure and development and in proper timed relation with movement of the photoconductor image sectors to transfer station 15, unit 35 signals actuation for feeding a copy sheet S to the transfer roller. Successive cyan, magenta, yellow and black toner images are then transferred to the copy sheet, in register, by the first, second, third and fourth image sectors of the photoconductor 11. Unit 35 then signals pick-off of the copy sheet by detack device 39, and copy sheet S is fed through fixing device F to a receiver bin. It will be appreciated that the successive reproductions of the composite original can be made in a continuous mode by repeating the above-described operation as the belt recirculates. Appropriate photoconductor cleaning and rejuvenation (known in the art can be provided along the return path from station 15 to station 12.

Apparatus 30 also can be operated in a black-and-white copy mode. In such operation, appropriate control information is input to unit 35, e.g. to select the black-and-white mode, the number of copies desired and any exposure level information for sources 17. Start of the copy run is commanded and control unit 35 effects repeated cycles of charge exposure and development as described above with respect to the fourth (black toner) sector on successive photoconductor image sectors. Copy sheet feed in this mode is activated for each photoconductor image sector, in contrast to the color mode where four toner images are transferred between each copy sheet detack and replacement cycle.

In a modification of the method and apparatus described for the embodiment of FIG. 3 when operating in the black-and-white mode (or a spot-color mode as will be described) exposure sources 17 and 18 may be used to provide a panchromatic screened exposure of original $O_1$ on one image sector of photoconductor 11 and sources 27 are used to provide an unscreened exposure of line-type information on document sheet original $O'_2$ onto a second image of sector of photoconductor 11. Original $O'_2$ is similar to original $O_2$ but does not have mask portions M since it is not used to expose the same image sector. The electrostatic latent images formed on both image sectors may be developed with the same or different colored toners and both developed images transferred successively to copy sheet S in accordance with the technique described for operation of the multicolor mode so that the images on both image sectors are registered accordingly on the copy sheet. In using a different colored toner to develop each image sector results such as a black and white screened pictorial with say red unscreened line-type spot-color information may be provided even though the line-type on original $O'_2$ is black.

Figure 4:
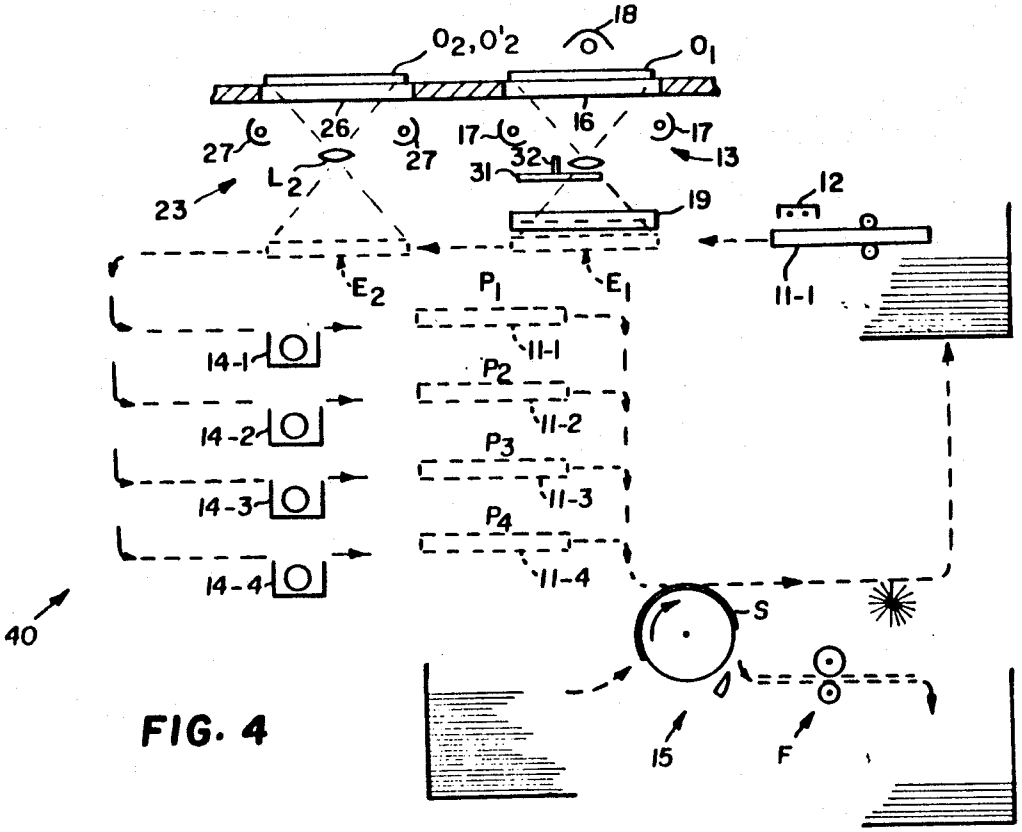
FIG. 4 is a schematic side view of yet another embodiment of electrophotographic apparatus for practice of the present invention.

FIG. 4 discloses another embodiment of electrophotographic apparatus 40 in accord with the present invention. Apparatus 40 is similar in functional capabilities to the FIG. 3 apparatus, and again, corresponding structural features are indicated with corresponding designators. The apparatus 40 differs from the FIG. 3 embodiment primarily with respect to the construction of the photoconductor image sectors and the operative path of the apparatus. Specifically, the photoconductor image sectors of apparatus 40 are in discrete sheet form and have separate paths within the development portion of the apparatus.

In operation in a color copy mode, originals $O_1$ and $O_2$ are prepared as described with respect to FIG. 3 and placed in register on platens 16 and 26. Appropriate control signals are input to a control and logic unit (not shown) and a start command is actuated. A first sheet sector 11-1 then is fed from a supply, primary-charged and exposed by device 13 via a red filter to original $O_1$ at zone $E_1$ (in the same manner described with respect to the first photoconductor image sector of the belt 11 of apparatus 30). The sheet 11-1 next is moved past exposure station 23 (without an exposure actuation), is developed by brush 14-1 with cyan toner and is moved to hold posttion $P_1$. Subsequently green and blue color-separation images are exposed on sheets 11-2 and 11-3 and the resulting electrostatic images are developed by magnetic brushes 14-2 and 14-3 and forwarded to hold positions $P_2$ and $P_3$. A sheet 11-4 is then primary-charged, exposed at station 13 (by source 17 only) and at station 23 by source 27, all in a manner like that described above regarding the fourth sector of apparatus 30. The composite image on sheet 11-4 is developed with black toner and sheet 11-4 is moved to position $P_4$. From this stage of the operation, the sheets can be forwarded to station 15 in any desired order for transfer of toner to a copy sheet S. As was the case with the FIG. 3 embodiment, apparatus 40 can be operated in a black only mode by successively repeating the sheet 11-4 sequence coordinated with successive copy sheet feed for each exposure sequence.

Alternatively when operated in a black-and-white or spot-color mode as described in the modification of the apparatus and method of FIG. 4, a first primary charged sheet sector is exposed at station 13 to imaging radiation from sources 17 and background erase radiation from source 18 both through screen 19 and with say a panchromatic filter. This sheet sector is transported past exposure station 23 without exposure and developed say using black toner to form a screened image of the continuous tone information on original $O_1$. The first sheet sector is then moved to a hold position. A second primary charged sheet sector is then transported (without exposure at exposure station 13) to exposure station 23 and subjected to imaging exposure of line-type information from original $O'_2$ shown in FIG. 3. This image sector is either developed with any one of the 4 color toners, as desired, and also stored in a hold position. A copy sheet S is then transported to station 15 and the developed toner images on each sheet sector is transferred to the same surface of the copy sheet S in suitable registration to form the composite image thereon. The composite image is then fused to the copy sheet in fusing station F.

Description will now be made with regard to the embodiment of FIGS. 5–8. This embodiment will be described in conjunction with the flow chart shown in FIG. 9 which illustrates the various steps the apparatus performs to provide a reproduction S having a screened image of pictorial information P and unscreened line-type information LT and which comprises a reproduction of an original D that has unscreened continuous tone pictorial portion(s) P and unscreened line-type information LT. It will be noted that in the embodiments to be described both the line-type information and unscreened continuous-tone pictorial portion(s) P are provided on a single document original (such as white paper) having reflective background portions B Returning to FIG. 6, an electrophotographic reproduction apparatus or copier 100 includes an endless or continuous belt-type photoconductive web 105 that is trained about six transport rollers 110, 111, 112, 113, 114, and 115. Roller 113 is coupled to a drive motor M in a conventional manner. Motor $M_1$ is connected to a suitable source of potential (not shown) when a switch (not shown) is closed by a signal from logic and control unit (LCU) 131. When the switch is closed, the roller 113 is driven by the motor $M_1$ and moves the web 105 in clockwise direction as indicated by arrow 116. This movement causes successive image sectors or frames of the web 105 to sequentially pass a series of electrophotographic work stations of the copier.

For the purpose of the instant disclosure, several copier work stations are shown along the web's path. These stations will be briefly described.

First, a primary charging station 117 is provided at which the photoconductive surface 109 of the web 105 is sensitized by applying to such surface a uniform electrostatic primary charge of a predetermined voltage. The station 117 includes an A.C. corona charger shown as a three wire A.C. charger. The output of the charger is controlled by a grid 117*a* connected to a programmable power supply 117*b*. The supply 117*b* is in turn controlled by the LCU 131 to adjust the voltage level Vo applied onto the surface 109 by the charger 117.

At exposure station 118, a light image of a document sheet original D supported on exposure platen 102 is projected onto the photoconductive surface 109 of the web 105 via mirrors 106, 108 and lens 107. The projected image dissipates the electrostatic charge at the light exposed areas of the photoconductive surface 109 and forms a latent electrostatic image. A programmable power supply 118*a*, under the supervision of the LCU 131, controls the intensity or duration of light from lamps 103 and 104 to adjust the exposure level E incident upon the web 105.

A magnetic brush developing station 119 includes developer which may consist of iron carrier particles and electroscopic toner particles with an electrostatic charge opposite to that of the latent electrostatic image. Developer is brushed over the photoconductive surface 109 of the web 105 and toner particles adhere to the latent electrostatic image to form a visible toner particle, transferable image. Other development systems than the one shown may be used; for example, see commonly assigned U.S. Pat. Nos. 4,473,029 to Fiitz et al and 4,546,060 to Miskinis et al. A programmable power supply 119D may be provided to adjust the level $V_B$, the voltage level applied to an electrode located in the station 119.

The copier 100 also includes a transfer station 121 shown as corona chargers 121*a* and 121*b*, at which the toner images on web 105 are transferred to a copy sheet S fed from a supply 123; and a cleaning station 125, at which the photoconductive surface 109 of the photoconductive layer is cleaned of any residual toner particles remaining after the toner images have been transferred and otherwise treated to restore its usefulness for the next exposure cycle. After the transfer of the unfixed toner images to copy sheet S, such sheet is transported to a heated pressure roller fuser 127 where the images are fixed to the copy sheet S.

To coordinate operation of the various work stations 117, 118, 119, 121 and 125 with movement of the image areas on the web 105 past these stations, the web has a plurality of perforations along one of its edges. These perforations generally are spaced equidistantly along the edge of the web 105. For example, the web 105 may be divided into six image sectors or frames by F perforations; and each image area may be subdivided into 51 sections by C perforations. The relationship of the F and C perforations to the image areas is disclosed in detail in commonly assigned U.S. Pat. No. 3,914,047. At a fixed location along the path of the web movement, there is provided suitable means 130 for sensing web perforations. This sensing produces input signals into the LCU 131 which has a digital computer, preferably a microprocessor. The microprocessor has a stored program responsive to the input signals for sequentially actuating then de-actuating the work stations as well as for controlling the operation of many other machine functions. An encoder 160 associated with the roller 113 also produces timing signals for the logic and control unit 131. The signals from the encoder cause the unit 131 to fine tune the process timing.

Figure 8:
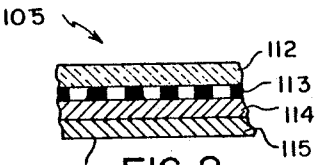
FIG. 8 shows an enlarged cross-section of a photoconductive web of FIG. 6, which includes an integral screen.

A half tone screen may be included as an integral part of th photoconductive web 105, such as illustrated in FIG. 8. Web 105 includes a transparent support 112, a screen 113, a conductive layer 114, and a photoconductive layer 115. The support 112 provides a mechanical strength to the other layers of the web and makes it suitable for use in electrophotograhhic copying machines. The screen 113 may be printed on the transparent support and is preferably formed of rows of dots. The dots may be colored such as magenta to operate with a complementary-colored (green) screen exposure light source shown as lamps 183 which provide an exposure of the screen pattern on the photoconductive surface 109 from the rear of the web. The screen pattern may be printed so that rows of dots on one image frame are rotated relative to rows on adjacent image frames so as to reduce moire patterns where the photoconductor is used to reproduce multicolor pictorial information as will be described in other embodiments. The screen, when used to provide screening for pictorial areas, is preferably of the type known as "soft" dots and may be comprised of lines or other shapes. Image exposure of document D is effected by flash lamps 103 and 104, which form a latent electrostatic image of the document sheet on the web. Formation of a plurality of charge islands within the latent electrostatic image is effected by the second uniform exposure through the rear of the web and through the integral screen 113 formed in the web. This rear exposure of the entire image sector may be carried out prior to, simultaneous with, or after image exposure of the photoconductor, the only requirement being that this rear exposure be carried out after charging and prior to development. Lamps 183 are energized by an adjustable power supply 184, which, in turn, is operated by the LCU 131. The output of the power supply can be varied to change the exposure of the lamps 183. The lamps 183 provide a uniform rear exposure through the screen 113 and serve to at least partially discharge all areas of the photoconductive layer 115 directly opposite transparent areas of the screen 113 thereby forming a plurality of very small charge islands on the photoconductive layer 115. The amount of exposure used to form these charge islands is varied according to a variety of factors including the nature of the photoconductive layer, type of developer, and mode of development.

Figure 6:
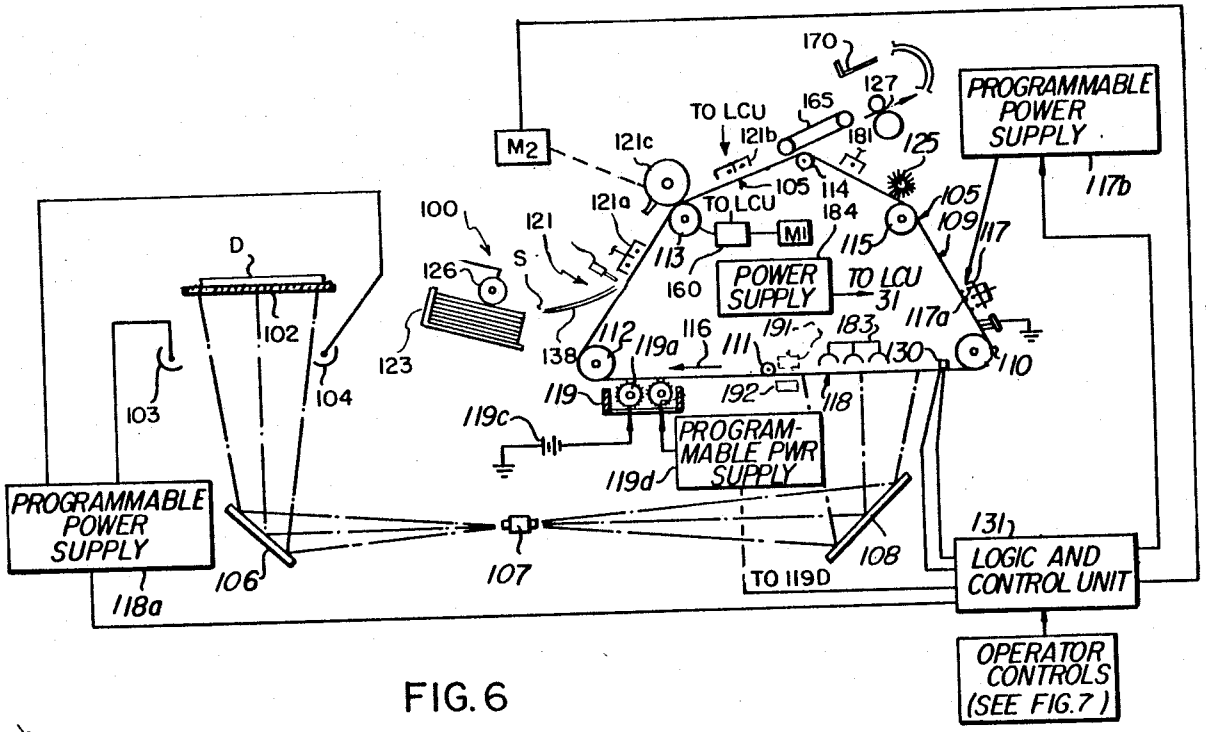
FIG. 6 is a schematic side view of the electrophotographic apparatus of FIG. 5.

A more preferred type of "lamp" for exposing the screen is shown in phantom in FIG. 6 and comprises an electroluminescent (EL) panel 191 which rather than being the size of a full image sector frame is made narrow and lies across the full width of the photoconductor frame (i.e. lies perpendicular to the direction of web travel). The panel is energized to emit illumination (green, for example) which exposes the portion of the dot pattern (magenta) in the path of this illumination onto the charged photoconductive surface. This illumination commences just prior to passage of an image sector area over the panel and terminates with the end of sadd sector area. The timing for this being controlled by logic and control unit 131.

Figure 7:
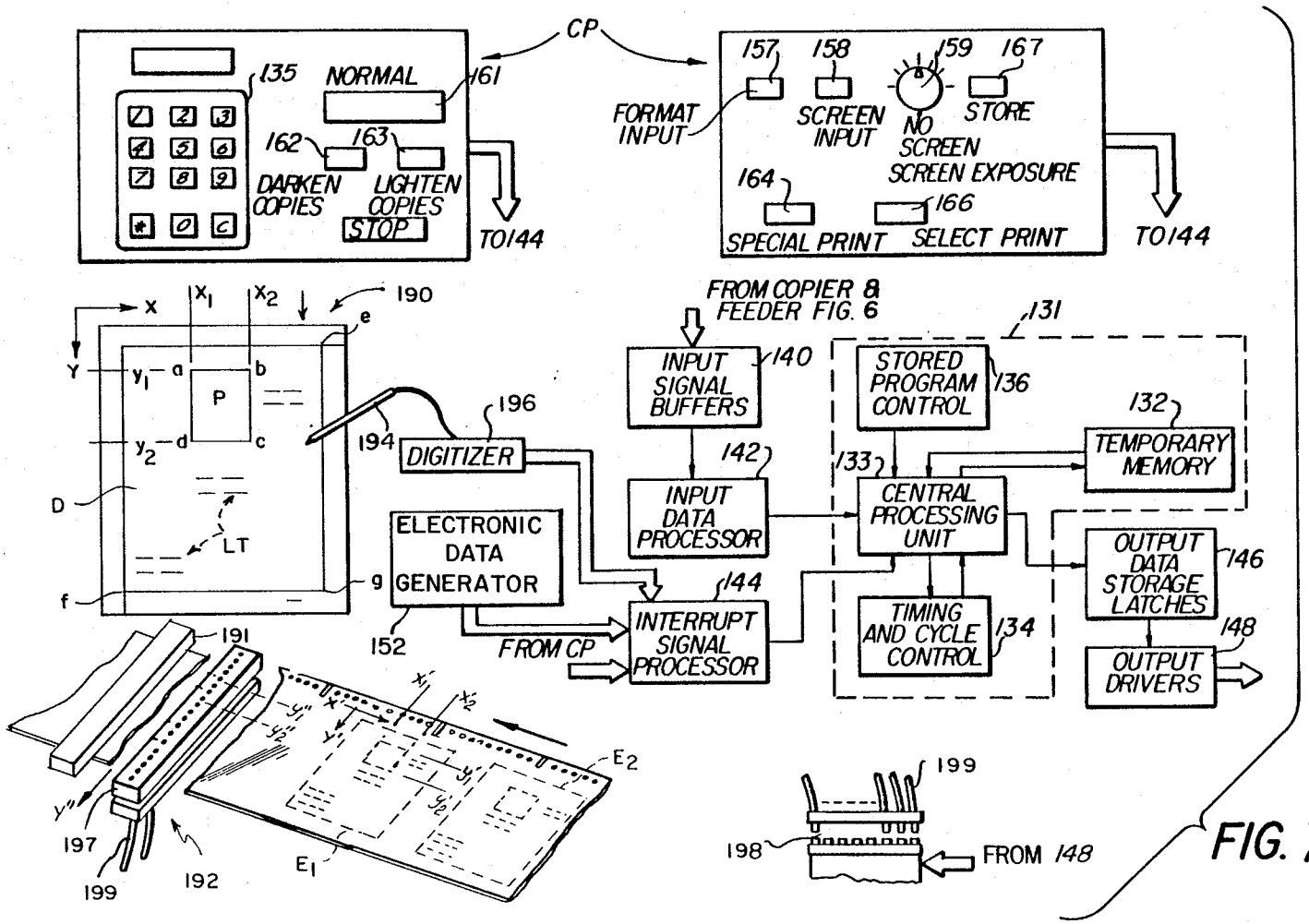
FIG. 7 is a block diagram of certain elements found in the apparatus of FIG. 5.

Turning now to FIG. 7, a block diagram of logic and control unit (LCU) 131 is shown which interfaces with the copier 100. The LCU 131 consists of temporary data storage memory 132, central processing unit 133, timing and cycle control unit 134, and stored program control 136. Data input and output is performed sequentially under program control. Input data are applied either through input signal buffer 140 to an input data processor 142 or to an interrupt signal processor 144. The input signals are derived from various switches, sensors, and analog-to-digital converters. The output data and control signals are applied to storage latches 146 which provide inputs to suitable output drivers 148, directly coupled to leads. These leads are connected to the work stations and to a copy sheet registration feeding mechanism 126. A copier keyboard 135 is shown connected to the interrupt signal processor 144. This keyboard 135 can be conveniently located on the operator control panel CP, and all its buttons provide inputs into LCU 31. In response to an input from the starred (*) button, a numeric code may be input into the LCU to call up a stored program for performing the type or mode of copy operation shown in FIG. 9. The operation of the apparatus in this mode will now be described.

Figure 5:
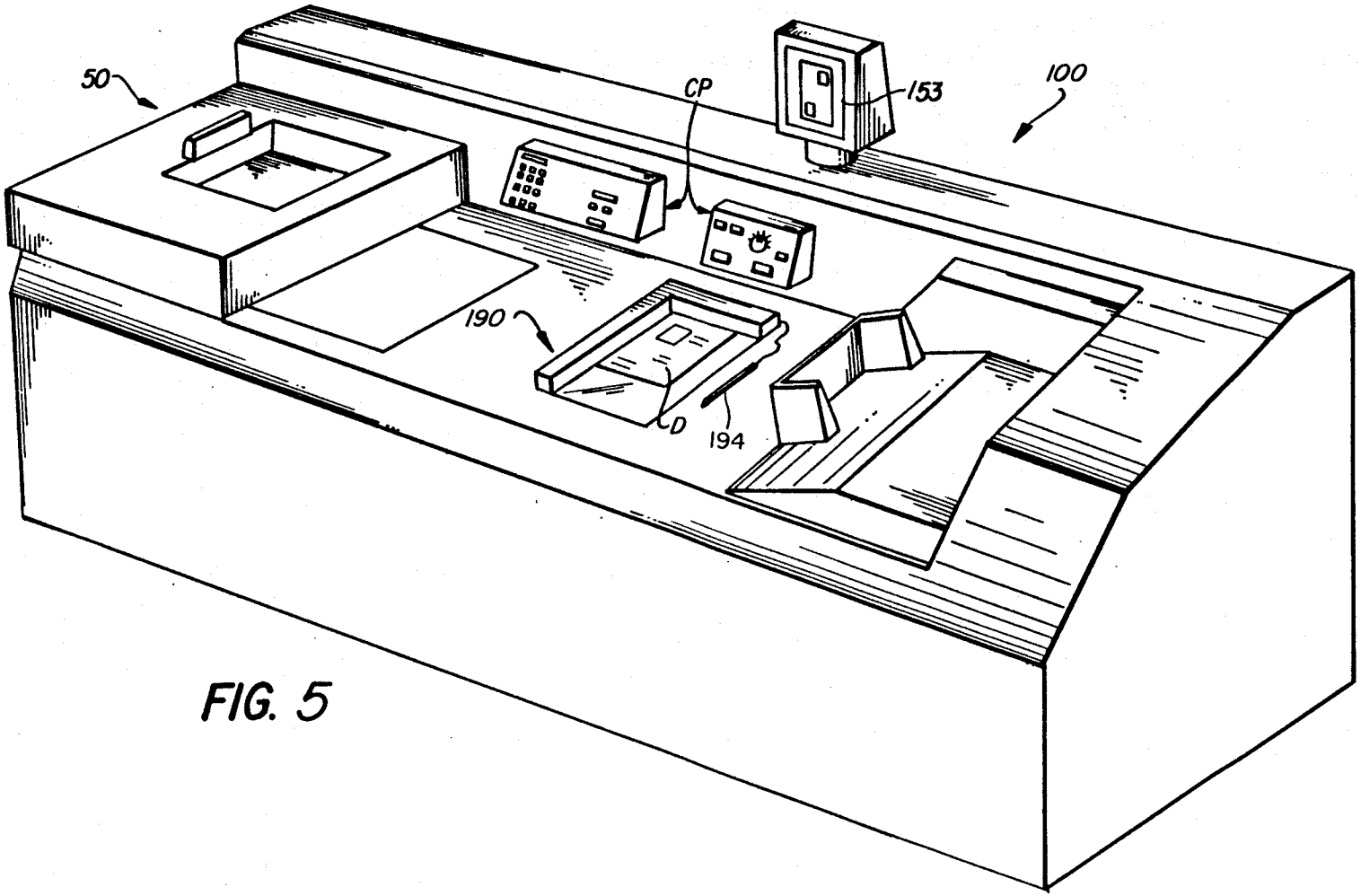
FIG. 5 is a perspective view of another embodiment of electrophotographic apparatus for practice of the present invention.

With regard also to FIG. 5, an operator first places the original document sheet D to be copied onto a digitizing tablet 190. A corner of the document sheet is registered in one corner of the digitizing tablet to establish a coordinate reference system for inputting information into temporary memory 132 regarding the location of the areas containing the continuous tone pictorial information. To enable the LCU 131 to receive this information as indicated above, the keyboard 135 is provided on the operator control panel and connected to interrupt signal processor 144. The starred (*) button thereof is used in conjunction with a numerical code inputted by the operator through depression of particular numerical buttons on the keyboard. When the appropriate code is provided, a program stored in stored program control 136 is called up and through a CRT or other display 153 (FIG. 5) requests that the operator indicate with use of a digitizing wand 194 handholdable associated with the digitizing tablet the position, relative to the registered corner of the document sheet, of the continuous tone areas to be selectively screened. For the rectangular continuous tone pictorial area P shown the wand may be used to touch the sheet at the four corner points of this area. Preferably the points are touched in an order such that a straight line joins adjacent points as in the order a,b,c, and d to define a rectangle. Alternatively, a rectangle may be defined by locating two diagonally opposite corner points with an input indicating that it is a rectangle. The computer control for the digitizing tablet may also be programmed to accept inputs of area data to define other geometrical shapes such as circles and other geometric shapes. Transducers located beneath the sheet produce signals relating the position of the points touched relative to the registered upper right corner of the sheet. A digitizing tablet of this type may comprise transparent electrically conductive films spaced from each other wherein one of the films is a conductive layer and the other resistive and which make contact when pressure is exerted against one of them by a finger or probe. Other similar tablets using capacitive films may also be appropriate. Alternatively, the tablet may be of the known sonic type wherein, for example, a spark formed by means within a wand creates sound waves in the air which are sensed by microphones placed along the sides of the tablet or wherein a sensor is placed in the wand and sources at known points on the sides of the tablet emit sonic signals either in the air or through a glass platen. (See, for example, U.S. Pat. Nos. 4,012,588 in the name of Davis et al; 4,124,838 in the name of Kiss and 3,134,099 in the name of Woo, the contents of each of which are incorporated herein by this reference.) A digitizer controller 196 knowing the times of emitting of the signals and their receipt can through triangulation principles calculate the location of a point on the platen relative to a known point such as the upper-left corner shown. The controller 196 for the digitizing tablet is programmed to recognize that the area is bordered by the straight lines joining adjacent points a,b,c and d and the coordinates for the area to be selectively erased can be thus calculated and communicated through input signal buffer 140 to be stored in temporary memory 132. This information is outputted on the display 153 showing the area to be screened. The coordinates for the points a, b, c and d would be $x_1$, $y_1$; $x_2$, $y_1$; $x_2$, $y_2$; and $x_1$, $y_2$, respectively. In order to display the appropriate size relationship between the area to be screened and the size of the document sheet, the computer control for the digitizer may be programmed to permit entry of data regarding document size, either through buttons pressed on the keyboard or by allowing the operator to input this information by touching corner points e and f (or only corner point g) on the digitizing tablet. Alternatively, where only one size document sheet original will be used with the apparatus, the size of the document sheet may be stored in the stored program control memory 136. Before use of the wand for each input, the operator will first identify the type of input by pressing the format input button 157 or screen input button 158. When introducing screen input information the operator will also adjust a screen exposure knob 159 which provides a means of adjusting the level of screen exposure for the particular area identified for screening. After the screen area is defined using the wand and the screen exposure level defined using the knob, the store button 167 is pressed to retain this information in memory in conjunction with this particular portion of the document sheet. Inputs from each of the buttons and knob provide digital level signals to the interrupt signal processor 144 for storage in the LCU's temporary memory 132.

If there is another continuous tone area to be reproduced, the operator moves the wand over the points designating this area on the document sheet. This information is also stored and displayed on the display by pressing the store button 167.

The operator next places the document sheet original D on the exposure platen 102 face down with the document sheet appropriately registered such as with an edge suitably centered against a registration edge on the platen or with some copiers registered with a corner. Sample exposures can be made to determine through trial-and-error the desired exposure by making exposures using the NORMAL, DARKEN and LIGHTEN copy buttons, 161, 162 and 163, respectively, which control document exposure and contrast in a well known manner. Prior to making these test copies, a SPECIAL PRINT button 164 is depressed which signals the LCU to make the copies using the information inputted about the areas to be screened and the desired screen exposure.

The SPECIAL PRINT button also inhibits operation of the copier until two inputs are made regarding the types of exposures desired for the document. For example, it may be desired to have the pictorial information exposed with less than the normal exposure and the line-type information be exposed with the normal exposure. The operator would then press, in order, the LIGHTEN and NORMAL buttons and the copying operation will commence.

The advantage of not inhibiting operation of the copier until actual copies are being made is desirable in that it allows one operator to input information about screen exposure and location of pictorial information using the digitizing tablet while the same or a second operator may be making copies of say another job.

However, where compactness is preferred the digitizing tablet as shown in phantom in FIG. 5 may be combined with the exposure platen 102 so that a document resting upon the platen glass face-up and suitably registered by a corner or edge thereof may have its size and areas to be say screened determined using wand 194 as described previously. The document can then be flipped over top-to-bottom so that the document remains registered either centered against its edge or a corner thereof located in the platen's registration corner. A digitizing tablet using a transparent platen without visible grid lines or at least not "visible" to the photoconductor has a distinct advantage over other types of digitizers since it can be located adjacent the exposure platen of a copier apparatus with the transparent glass exposure platen serving as both the support for digitizing purposes and as the support for the exposure operation. Providing the digitizer without visible grid lines will also not impose constraints on the type of photoconductor or exposure light source used since it is not desirable to reproduce the lines of the grid on any reproduction. This would be especially advantageous in a color copier apparatus where the grid lines should not be visible at all. In addition to use of the digitizing tablet for inputting of information regarding an area to be screened, there is also described herein with regard to FIG. 11, that the information from the digitizer may be used to selectively erase charge from certain image sectors so as to provide spot color; i.e., reproduction of information in several different colors from an original in one color. This is accomplished by selectively erasing the information to be spot colored from one image sector and selectively erasing the complementary information from the other image sector, developing the sectors with different colored toners and transferring the images in register onto the same surface of a copy sheet. Other known uses for digitizers may also be provided for in the apparatus using the preferred digitizers described herein.

Figure 9:
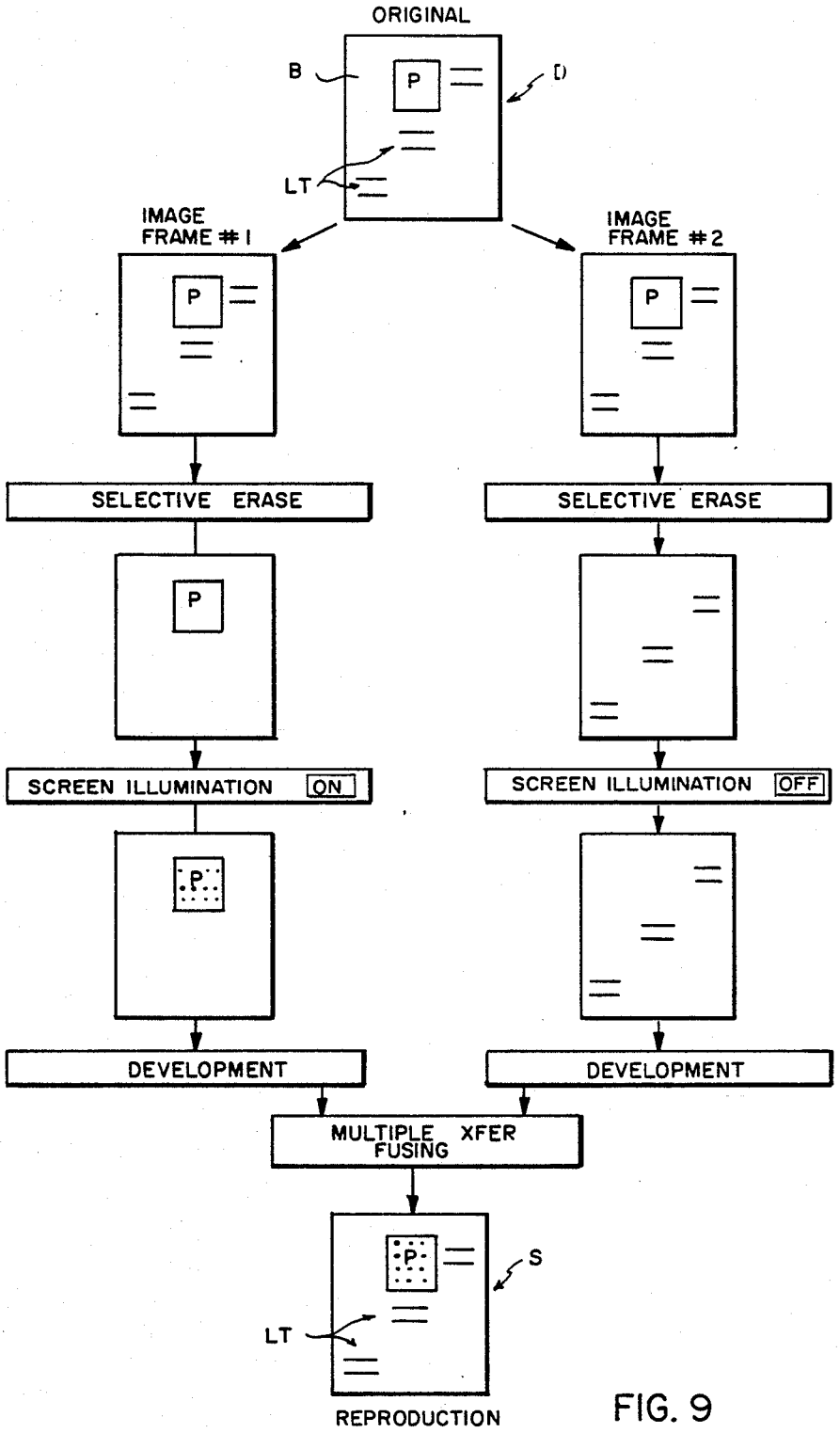
FIG. 9 shows a flow chart illustrating the steps for producing a composite reproduction having screened pictorial information and unscreened line-type information using the apparatus of FIG. 5

Original document sheet D as indicated above and shown in FIG. 9 includes unscreened continuous tone pictorial area(s) P such as a black-and-white photograph and is mounted on or otherwise located on a portion of the document D which includes white reflective background portions B. In these background portions there are provided line-type information of the kind described above. In synchronization with the location of a first image sector $E_1$ at exposure station 118, the flash lamps 103, 104 are illuminated in accordance with the operator's first exposure input and an image of the entire document is exposed onto the primary charged photoconductive surface 109 of this image sector. Simultaneously with this exposure the screen pattern may be imaged onto the photoconductor by illumnnation of lamps 183 or more preferably electroluminescent (EL) panel 191 (shown in phantom in FIG. 6 and referred to above) and which is logically coupled to the LCU and receives signals therefrom indicating commencement and termination times for its illumination. For the image sector $E_1$, the EL panel illuminates a screen pattern onto the full area of this first image sector. Opposite the photoconductive surface 109 there is provided another linear illumination source 192 which comprises a plurality of light emitting diodes (LED's) 198. These LED's are coupled to the output drivers 148 of the LCU. Opposite each of the LED's are the ends of a bank of fiber optic light pipes 199 whose opposite ends are arranged in a row across the photoconductor. A SELFOC (trademark of Nippon Sheet Glass Company, Ltd.) gradient index lens array (GRIN) 197, is located proximate the rear of the web and is directed transverse to the direction of web movement. The GRIN 197 focuses the light from the output ends of the fibers onto the surface 109 of the web.

Prior to or as the first image sector $E_1$ on the photoconductive web 105 upon which the image of the document sheet D is to be formed passes above the GRIN, the LCU calculates which of the LED's to illuminate and the duration for such exposure.

For the document original shown all the LED's will be turned on as the first part of the image sector overlies the GRIN, since it is desired to erase all charges on this sector but for that comprising the electrostatic latent image of the pictorial information P. As shown in FIG. 7, the portions of the GRIN between the ordinates $y''_1$, $y''_2$ on the Y" axis of the linear GRIN correspond to their respective counterparts on the original document and to their respective ordinate counterparts $y'_1$, $y'_2$ on the y' axis of the image frame. This ordinate pair defines a transverse line past which a respective latent electrostatic pictorial tone image area on the photoconductor will pass. When this pictorial area begins to pass directly above the GRIN 197, the appropriate LED's are turned off by the LCU. The parameters for determining the timing of when to terminate illumination and when to commence illumination of the respective LED's are provided by the abscissa pair $x'_1$, $x'_2$ of the image frame, respectively. Thus, when the portion of the image frame corresponding to the transverse line $x'_1$, as determined by signals provided by the LCU, overlies the linear GRIN array the LED's providing illumination between $y''_1$ and $y''_2$ are extinguished. This extinguishment lasts until the transverse line $x'_2$ (also determined by the LCU) passes by the GRIN in which case these LED's are once again illuminated.

It should be appreciated that in the use of LED's as an illumination source for selective erase, it is not necessary that, during a period of their being illuminated for erasing charge from the photoconductive layer, the LED's be continuously illuminated. Rather each LED can have the respective electrical current thereto pulse-width modulated for a predetermined short period of time so in essence the illumination from each LED comprises a rapid series of flashes. The pulse-width time or other parameter of each pulse for each LED can be individually tailored so that the LED's provide sufficient output during each "flash." The important feature is that they be set so that illumination therefrom erases charge from the photoconductive surface 109 to a level below which development will occur. After erasing all charge from the first image sector $E_1$ except for the pictorial area P, the LED's may remain illuminated to serve as an interframe or format erase.

The document D is again exposed by flash illumination from lamps 103 and 104 and forms an electrostatic latent image at station 118 on the second image sector $E_2$. When the second image sector passes between the two linear illumination sources the EL panel 191 remains off entirely for this frame so as to provide no screening of the information to be developed thereon. The LED or selective erase panel 192, on the other hand, is selectively illuminated to erase all charge in the area of this sector upon which pictorial information has been imaged. Thus, onyy LED's providing illuminaiion between ordinates $y''_1$ and $y''_2$ are illuminated and only for the duration commencing with the location of the $x'_1$ abscissa coordinate of this sector in overlying relationship with the GRIN and terminating illumination with the passage of the $x'_2$, abscissa coordinate in overlying relationship with the GRIN.

The electrostatic images remaining on the two image sectors are developed at development station 119 and transferred to a copy sheet S in register as will be now described.

Receiver or copy sheets S are stored in a supply stack supported in a hopper 123 within the copier frame. A feeder 126, such as an oscillating vacuum feeder, removes a sheet S from the stack and delivers the sheet through a guide 138 into contact with the traveling web 105. Timing of actuation of the feeder 126 is controlled by the LCU so that the fed receiver sheet reaches the web 105 with its lead edge in register with the lead edge of the image sector $E_1$ containing the first developed (pictorial) image of document D. The receiver sheet travels with the web beneath a first transfer corona charger **121*a* located adjacent to the periphery of the web travel path on the same side of the web as the receiver sheet. The corona charger 121*a*** has an impressed D.C. voltage sufficient to produce an ion flow which charges the receiver sheet to the extent that toner particles of the first developed image are attracted from the web to the receiver sheet.

In order to register the receiver sheet with the next developed image, the receiver sheet is removed from the web and then returned into contact with the web as the area bearing the next image reaches the location where the receiver sheet is returned to the web. Specifically, removal and return of the receiver sheet is accomplished by register means located downstream of the transfer corona charger **121*a*. The register means may be, for example, a roller 121*c* in juxtaposition with the web 105. The roller 121*c* has a circumference equal to the dimension of one image area of the web (in the direction of web travel) plus the distance between two adjacent areas, and is rotated at an angular velocity so that the tangential velocity at the periphery of the roller equals the linear velocity of the web. Drive for the roller 121*c*** is preferably provided by a stepper motor $M_2$ which receives actuating signals from the LCU.

When the lead edge of the receiver sheet reaches the element of the roller **121*c* closest to the web, the lead edge is tacked to the roller, such as by vacuum from a vacuum source V connected to the roller and operative through ports in the roller, or any other appropriate means. The tacking action (induced by the vacuum) is controlled by the LCU so that, as the roller 121*c* is rotated, the receiver sheet is removed from the web 12 and rotates with the roller as the web continues to move along its travel path. Since the image bearing surface of the receiver sheet does not contact the roller, the transferred image is not disturbed by the register means. Continued movement of the web and synchronized rotation of the roller brings the lead edge of the receiver sheet back into contact with the web as the lead edge of the next image area bearing the line-type image on Sector $E_2$, arrives at the recontact location. At this point in time, based on signals provided by encoder 160** to the LCU, the receiver sheet is detacked from the roller (vacuum supply interrupted by the LCU to enable the sheet to travel with the web). In this manner, the image in the next image sector $E_2$ is in registered superimposed relation to the previously transferred image on the recevver sheet.

The web and the registered receiver sheet then travel beneath a second transfer corona charger 54 located adjacent to the periphery of the web travel path on the same side of the travel path as the receiver sheet. The corona charger **121*b* functions, substantially in the same manner as the corona charger 121*a*, to transfer the second developed image to the receiver sheet. The D.C. voltage impressed upon the corona charger 121*b* is controlled by the LCU and may be different from the voltage impressed upon corona charger 121*a***. Since the second image on the web is in register with the first image on the receiver sheet, accurate superimposed transfer of the second image onto the same surface of the receiver sheet relative to the first image occurs.

After the transfer of the second image is complete, the receiver sheet is detacked from the web 105 and moved along a path away from the web by a sheet transfer apparatus such as, for example, a vacuum transport 165. The transport 165 engages the receiver sheet on the opposite side from the superimposed toner images so as not to disturb or smear the toner images. The vacuum transport 165 delivers the sheet to a fixing apparatus such as, for example, roller fuser 127. The fuser 127 applies heat and pressure to the composite toner image and receiver sheet to fuse the toner image and permanently fix the image to the receiver sheet. The receiver sheet is then delivered to an exit hopper 170. While the image is being fixed to the receiver sheet, the web 105 continues to travel about its path through cleaning area 125. In the cleaning area, a fiber brush rotating in a vacuum housing (not shown), for example, contacts the web to remove any residual, nontransferred toner. To facilitate toner removal the web 112 may be subjected to illumination from an erase lamp to cancel any field within the photoconductor and charge from an A.C. charger 181 to neutralize the charge on the web. The web then travels back under the primary charger 117 where it is recharged so that the reproduction cycle can be repeated. As may be seen in FIG. 9 the resulting copy sheet S includes a screened pictorial reproduction of the continuous tone pictorial portion of original document D and an unscreened reproduction of the line-type information found in the original.

Figure 10:
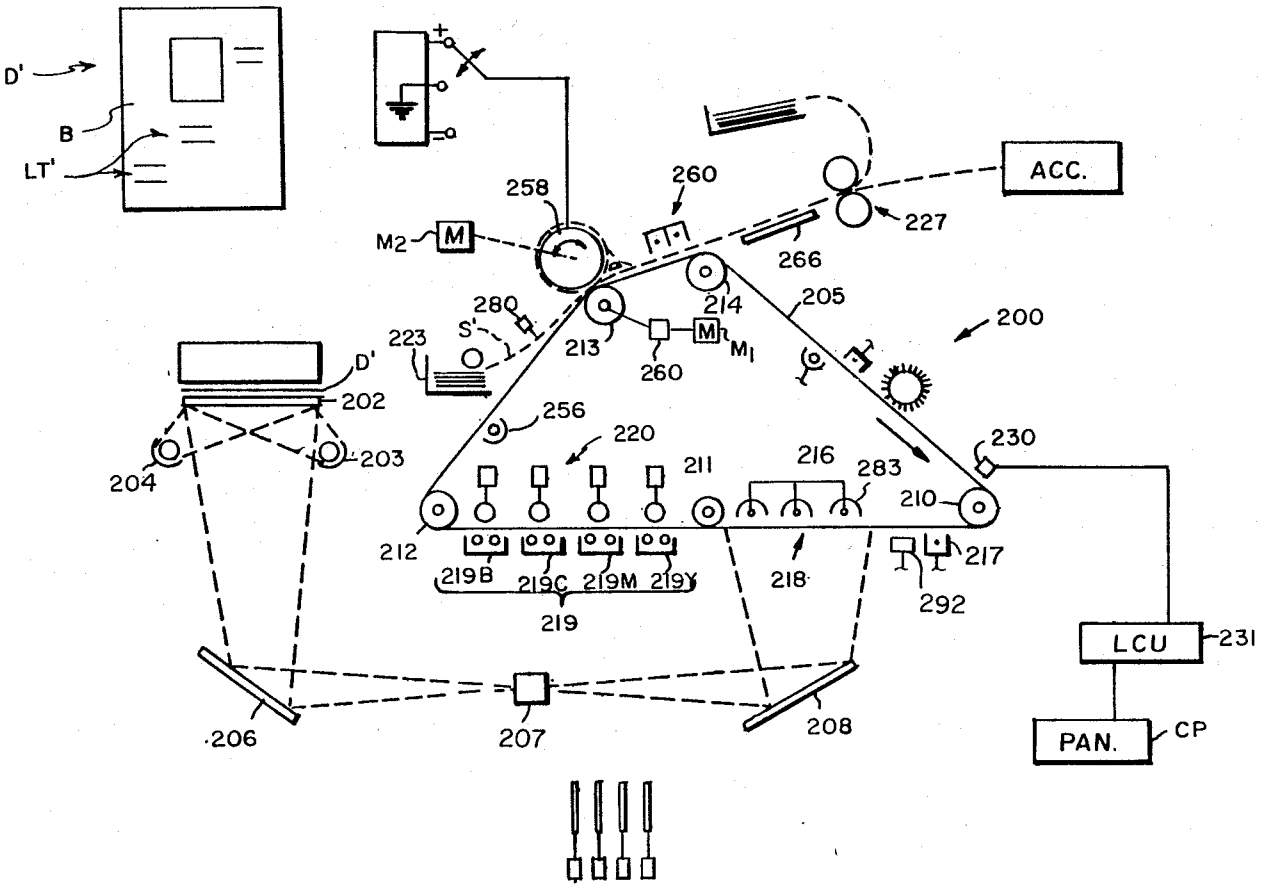
FIG. 10 is a schematic side view of yet another embodiment of electrophotographic apparatus for practice of the present invention.

In FIG. 10 an electrophotographic apparatus 200 is shown which is adapted to produce multicolor reproductions. Many of the operation stations of the apparatus of FIG. 10 are similar in function to those described in detail for the apparatus of FIG. 6 and will only briefly be referred to in the description of apparatus 200. A multicolor original document sheet D' having a multicolor continuous tone pictorial area P', and line-type LT' information in one or more colors that may also include halftoned color originals that are to be reproduced in four colors. As in the embodiments heretofore described the continuous tone pictorial information is reproduced using a screened pattern and the line-type information is reproduced without use of such pattern.

The document sheet D' is placed on a digitizing tablet (not shown) associated with apparatus 200 and used to determine coordinates for the location of the pictorial information vis-a-vis a reference point on document sheet D' such as one corner thereof or a center of referenced edge. The tablet may also be used to input sheet format. With the relative location of the pictorial information stored in memory, the apparatus 200 can be operated as follows to provide multicolor reproductions. With the document placed on the transparent platen 202, flashlamps 203, 204 illuminate the document up to eight successive times. Each exposure made images the document's information on a different exposure sector at exposure station 218 via mirrors 206, 208 and lens 207. Each exposure of a sector is made through one of four filters, i.e. a neutral density filter (black sector) three color separation filters red (cyan sector), green (magenta sector), and blue (yellow sector). The photoconductor web or belt 205, which is similar in structure to that shown in FIG. 8 is moved continuously in the direction of the arrow 216 by drive motor $M_1$ and trained about rollers 210–214. Position information of individual sectors is tracked by information provided by perforation detector 230 and encode 260. The information recorded on photoconductor 205 is in the form of an elettrostatic latent image which has modified a uniform electrostatic primary charge previously impressed upon the photoconductor by primary charger 217. As the first four exposures are made to reproduce the pictorial component of the document's information a screened pattern is exposed on the entire area of each of the first four image sectors by flash illumination from the rear of the photoconductor by lamps 283 or alternatively an EL panel either of which may be located between the primary charger 217 and the development stations 219. Also located between the developments stations and the primary charger is a selective erase illumination array 292 which as described previously selectively erases charge from portions of each sector. For the first four image sectors exposed the selective erase panel erases the background area B so that the electrostatic image remaining on each of these first four image sectors comprises solely pictorial information that has been modified by a screen pattern during this reproduction process. The charge on the background area B has been reduced to a level below which development will occur. The remaining four of the eight exposed image sectors are each exposed to the image of the document sheet D' through a respective one of the four filters in the same order as that used for the first four exposures. The screen exposure lamps 283 or EL panel is not illuminated for these four image sectors so no screen pattern is imaged upon these sectors during this reproduction process. The selective erase illuminating array is selectively illuminated to erase only the area of each of these sectors upon which the continuous tone pictorial information is imaged so that the charge level is such in these areas that it is below that which will develop. Each of the eight image sectors is developed by a respective toning station comprised of respectively black colored toner (219B), cyan colored toner (219C), magenta colored toner (219M), and yellow colored toner (219Y). A sector is toned with its respective toner as it passes through the development station and a respective one of the back-up rollers 220 is actuated to bring the photoconductor into close proximity with a respective magnetic brush toning roller situated on the respective toning station. After development each sector may be subjected to a post-development erase lamp 256 which reduces the electrostatic attraction between the toner image and web to facilitate transfer to a copy sheet and to reduce photoconductor fatigue. A copy sheet S' is fed from a supply stack stored in hopper 223 in synchronism with movement of the first sector so that the copy sheet engages the web and is registered by mechanism 280 with the first image sector. A transfer roller 258 which is similar to that described in U.S. Pat. No. 4,477,176 to Matthew J. Russel, the contents of which are incorporated herein, inclddes a compliant insulating surface thereon and is biased to a potential suitable for transfer of the developed image on the first image sector to the copy sheet S' and to tack copy sheet S' to roller 258. Roller 258 is driven by a stepper motor $M_2$ which receive actuating signals from the LCU 231.

Roller 258 may also be a biasable vacuum roller or a roller with sheet clamping mechanisms to clamp the sheet to it.

Continued movement of web 205 and synchronized rotation of roller 258 brings the lead edge of copy sheets back into transferable relationship with the web as the lead edge of the next toner image arrives at roller 258. At this point, sheet S' remains tacked to roller 258 and the second toner image is transferred in superimposed registration with the first toner image on sheet S'. The process is repeated until toner images on each of the first seven image sectors have been transferred to the same surface of sheet S' and the leading edge of copy sheet has been brought back into transferable relationship with the eighth toner image on the web. When the lead edge of copy sheet S' is brought back into transferable relationship with web 205 for the last time, the bias on roller 258 is reversed to repel sheet S' away from roller 258 back into contact with web 205. Copy sheet S' will be carried by web 205 so that the copy sheet is in registration with the image on the eighth image sector. This image is transferred to the copy sheet by transfer station 260. The copy sheet is separated from the web and conveyed by air transport 266 to fuser 227. The copy sheet then is conveyed to an exit hopper or other accessory or sorting device.

Where the line-type information is all in one color, provision may be made in the programming of the controls for exposing only one of the four sectors used for recording line-type information and developing the line-type information using toner of a desired color. Of course, more than one and less than four colors for developing line-type information may be provided for as well.

While the information providing discrimination between pictorial and line-type information is determined using a digitizing tablet using an operator input, the information may also be obtained automatically, for example, as described in commonly assigned Application Ser. No. 809,548 (abandoned in favor of U.S. application Ser. No. 940,694, filed Dec. 11, 1986) filed on even date herewith and entitled, "Electrophotographic Reproduction Apparatus and Method With Automatic Selective Screening, in the name of George N. Tsilibes. Cross-reference is also made to commonly assigned U.S. application Ser. No. 809,549, filed on even date herewith in the name of P. B. Day and George N. Tsilibes and entitled, "Electrophotographic Reproduction Apparatus and Method with Selective Screening," and to commonly assigned U.S. application Ser. No. 809,547 (now abandoned in favor of continuation-in-part application No. 132,637, filed Dec. 9, 1987), filed on even date herewith in the name of Matthew J. Russel and entitled, "Automatic Spot Color Copying Apparatus and Method", the contents of these three applications being incorporated herein.

Figure 11:
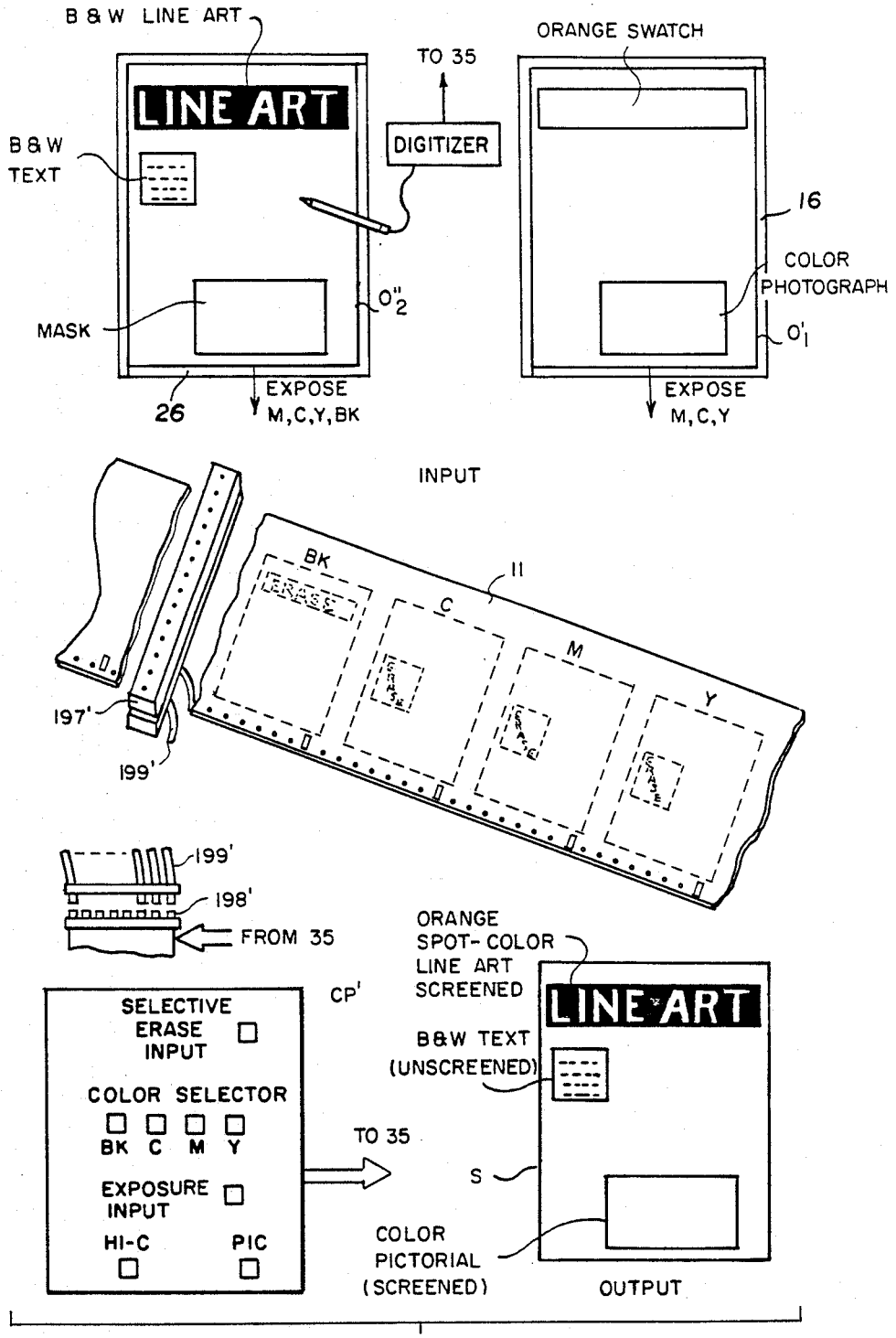
FIG. 11 is a schematic view of yet another aspect of the invention.

With reference now to FIG. 11, there is illustrated a pair of document originals $O_1''$, $O_2''$ for reproduction with a double platen type exposure system such as shown in FIG. 3. In the reproduction of this document pair, use of a digitizing tablet and selective erase will be made. Document $O_1''$ is supported on a pictorial platen 16, for exposure on each of the three color image sectors or frames of photoconductor 11 by lamps 17 through halftone screen 19 and respective color separation filters provided on a filter wheel 31. Document $O_2''$ is supported on a high contrast platen 26 for exposure by lamps 27 on each of the same three color image sectors as well as black developing image sector. Document $O_1''$ comprises an opaque white support upon which is mounted a multicolor photograph and also an orange swatch. Document $O_2''$ comprises an opaque white support having a black mask of a size identical with that of the photograph and located so that exposures of document $O_2''$ on each of the three color image sectors will not reduce the charge on such sectors where the color photograph is to be reproduced. Document $O_2''$ also includes black and white textual material as well as black and white line art. The line art is to be reproduced in the color of the orange swatch. Before placing the document $O_2''$ on its respective platen the document is placed on a digitizing tablet such as that described previously or as shown the tablet may form a part of each respective platen. Inputs are then provided through the digitizer to the logic and control unit 35 as to which areas on which image sectors are to be selectively erased. Thus, the operator may press an erase input button on a control panel CP' and a specific sector color or colors and use the digitizer to indicate the area(s) on each color sector to be erased. Control panel CP' may also have provision for indicating which photoconductor sectors are to be exposed to the document on the high-contrast platen and which are to be exposed to the document on the pictorial platen.

In the example, illustrated in FIG. 11 exposure of the high contrast document $O_2''$ will be made on the magenta, cyan, yellow and black image sectors. Exposure of the pictorial document $O_1''$ will be made on the same magenta, cyan and yellow image sectors. Exposure lamp 18 need not be used. After exposure of each image sector the logic and control unit 35 enables appropriate LED's 198' which comprise the selective erase means and which illuminate the photoconductor through a linear array of fiber optic light pipes or fibers 199'. A "GRIN" array 197' may also be provided for focusing the output from the light pipes. Alternatively, in this and other embodiments described herein a line of LED's may be arranged across the photoconductor without use of light pipes and a GRIN or the LED's used with only a GRIN. FIG. 11 indicates schematically the areas of each sector to be selectively erased. On the black sector (BK) the image area for reproduction of the line-art is erased as the line-art is to comprise a combination of cyan, magenta and yellow toners only. Also, the area corresponding to the mask is selectively erased. In the color frames (C, M and Y), the area corresponding to the image of the black and white text is erased since this area will only be developed using the black toner. The orange swatch will alter the primary charge level on each frame in accordance with the response of the photoconductor to the color separation reflection characteristics of the swatch. The color on the swatch is preferably formed on color photographic paper who's reproduction compatibility has been established with the apparatus. Before exposure the primary charge to be impressed on each photoconductor sector may be preadjusted to different levels so that colors from a known standard will produce reasonably faithfully. Thus, a programmable power supply coupled to charger 12 in FIG. 3 may be used to provide different primary charge levels to each of the image sectors. Alternatively, trial runs may be made to adjust the primary charge and other copier process parameters so that colors are faithfully reproduced. The exposure of the line-art on document $O_2''$ will modulate with character information the primary charge levels on each of the color image sectors.

The three color image sectors are developed with cyan, magenta and yellow toners respectively and the fourth with black toner as described previously with regard to stations 14-1 through 14-4. The four developed images are transferred serially in register from the photoconductor to the same surface of a storage medium such as copy sheet S''. The resulting output S'' is shown also in FIG. 11.

As will be noted, the reproduction S'' includes orange colored line-art from a black and white original. In addition the line-art in this example will be screened because of the exposure of the swatch through screen 19 (or a screen image may be provided by using an integral screen photoconductor and screen illumination source as described with regard to the embodiment of FIG. 6.) This will break up the solid area nature of this image and facilitate developeent without the appearance of streaks or mottle usually associated with development of large solid areas. The black and white text will be reproduced without modulation by a screen which is usually desirable in reproduction of alpha-numeric line-type information. The color photograph will be reproduced on S'' through halftone screen 19 to reduce contrast of the reproduction while background areas to be reproduced in white will be clean due to their being erased by exposure of the white areas of the high contrast document $O_2''$ without modulation by a screen.

In order to reproduce the black and white line-art in red instead of orange, a red patch would be substituted for the orange patch and the exposure of this line-art on the cyan sector selectively erased so that the exposures on the magenta and yellow sectors when developed and transferred in register to a copy sheet will produce a red spot-color reproduction of the line-art on the copy sheet with screened reproduction of the color pictorial and unscreened reproduction of the black and white text.

If it is desired to reproduce the black and white text in red, for example, the selective erase means may be used to erase the black and white text information from the black and cyan sectors and not erasing such information from the magenta and yellow sectors. Thus, when all four sectors are developed and transferred in register onto a copy sheet, the text will be reproduced in red and not be screened, the line-art will be reproduced in orange and the color pictorial will be reproduced with reduced contrast as a screened color pictorial.

Thus, there have been described several embodiments of electrophotographic apparatus that are adapted in accordance with the invention to provide reproductions of an original or originals having continuous tone pictorial information and line-type information that are to be reproduced so that the reproduction has a composite image of screened pictorial areas corresponding to the pictorial information of the original(s) and unscreened areas containing reproductions of the line-type information with background areas being relatively clean. In addition, there has been described apparatus and methods for reproducing line-art in a desired color using a patch of that color without the need for modifying the color of the line-art original.

Modifications of the above-described apparatus may be made to provide reproductions of originals having the continuous tone and perhaps other information in the form of transparencies rather than opaque originals. For example, a photographic transparency may be mounted upon an opaque support with a cutout in the support allowing illumination to illuminate the transparency from behind and image same onto an image frame of the photoconductor. Lamps located in front of the original may be used to expose the opaque white background of the original onto the same image frame to reduce the background areas to a level below which will permit development or these background areas may be exposed by electronic selective erase. Other modifications may comprise the use of electronic imaging means to provide image information on one or more of the image frames. The electronic image means would be used to modulate light in accordance with the information stored in an electronic data generator 152 as a bit stream. For example, the selective erase means may comprise a light source such as a laser and a solid state aperture array modulated by an electronic bit stream to provide, for image frame #1 in FIG. 9, the means for selectively erasing charge from the non-pictorial optically exposed image area(s). The aperture array would be modified by the bit stream to provide a mask to preclude exposure of the laser beam to the area(s) of image frame #1 reproducing the pictorial information. The solid state array would be modulated by the bit stream to allow the laser to erase all areas of image frame #2 except that reproducing the line-type information thereon without use of an optical exposure on this image frame. This could be accomplished by using a linear or areal aperture array of the size of the image frame and having the array be transparent where erasure of charge is desired and block light where image information is desired. The array could be programmable to form line-type information or do editing in accordance with signals provided by the bit stream and thus modulate the charge on image frame #2 with line-type information. Programmable electroluminescent light panels or LED's or lasers which may be selectively illuminated may also be used to "write" and perform selective erase and do not require a separate masking or aperture device. The use of LED's for writing of information on a photosensitive surface is well known; for example, see U.S. Pat. No. 4,525,729 (Agulnek et al), the contents of which are incorporated herein.

When using electronic image means such as LED's for writing of the line-type information, it is desirable to have a photoconductive and/or development system that will develop at points where an exposure is made since an image frame reproducing only line-type information will have the image information be only a small part of the total image area of the frame. That is, background areas usually comprise the greater part of the area of an image frame or sector reproducing line-type information and it, thus, requires more energy to expose background areas and develop unexposed areas than to leave background areas unexposed and develop exposed areas. However, for reproduction of pictorial information as described herein wherein a screen pattern is impressed upon an entire image frame and pictorial information optically exposed onto a portion of the iamge frame, it is desirable to selectively erase the screen artifacts on the background portion of the image frame. To make a selective erase light source suitable for erasing of screen artifacts on one image frame where points that are exposed are erased and for writing directly on a second image frame where exposed areas are printed, the following may be done. A bipolar photoconductor suitable for accepting both positive and negative charges may be used. The image frame to be exposed optically that is through a transmission or reflection exposure of an original continuous tone pictorial or photograph is charged by a corona charging source to provide a primary charge of one polarity for example negative. A screen image is exposed onto the entire image frame and background areas of this frame erased by either an electronically addressable selective erase means such as LED's or a separate exposure through a transparent support upon which the continuous tone pictorial is mounted. When this image frame is transported to a development station to be developed with positively charged toner particles, the toner will develop in the non-discharged image areas. The second image frame is charged by the corona charging source to provide for example a positive primary charge. The line-type information is imaged upon this frame preferably using the electronically addressable selective erase means. Where the photoconductor is exposed to the light from say LED's, the positive toner used to develop this image frame will be attracted to the discharged image areas when the second image frame is transported to the same development station. The two developed image frames may then be transferred in register onto a copy sheet.

Description has been provided herein with regard to reproduction apparatus using belts or webs or sheets where exposure of different image sectors refers to spatially diffrrent portions of the photoconductors described. It should be appreciated however that where smaller photoconductors are used, such as drums, the image sectors may be considered different in the temporal sense. For example, a photoconductor may be exposed to an image of a continuous tone pictorial original, have its background areas be selectively erased and the electrostatic image screened, the screened image be developed and transferred to a copy sheet, the photoconductor cleaned, and the next exposure of the original be on the same photoconductor portion. For this next exposure, the pictorial information imaged on the photoconductor may be selectively erased, the line-type information developed and transferred in register on the same surface of the copy sheet having the previously transferred image of screened pictorial information. In this regard, the use of a rotating drum type photoconductor is also contemplated wherein the image of the original(s) is reflection scanned upon the drum.

The invention has been described in detail with particular reference to preferred embodiments thereof, but it will be understood that variations and modifications can be effected within the spirit and scope of the invention.

We claim:

1. A method for electrophotographically producing a reproduction having a composite image of screened image areas of pictorial information and unscreened image areas of line-type information, the method comprising:

(a) uniformly electrostatically charging each of two photoconductor image frames;

(b) forming on one image-frame an electrostatic screened image of pictorial information by reflection exposure of an original having the pictorial information as an unscreened continuous tone image;

(c) erasing background areas of the said one image frame which border the pictorial information exposure, using means separate from that used in step (b), to reduce the charge in the background areas to a level below which will permit development;

(d) forming on the second-image frame an electorstatic unscreened image of line-type information by reflection exposure of an original having line-type information;

(e) developing the images on the two-image frames with toner; and (f) transferring the developed toner images from respective image frames in register onto a copy sheet.

2. A method for electrophotographically producing a reproduction having a composite image of screend image areas of pictorial information and unscreend image areas of line-type information, the method comprising:

(a) uniformly electrostatically charging each of two photoconductor image sectors;

(b) forming on one image-sector an electrostatic screened image of pictorial information by exposing the one image sector to light from an exposure of an original having the pictorial information as an unscreened continuous tone image;

(c) adjusting the charge in the background areas of the said one image sector which border the pictorial information exposure, using means separate from that used in step (b), to alter the primary charge in the background areas to a level which will permit no development;

(d) forming on the second image sector an electrostatic unscreened image of line-type information by exposing the second image sector to light modulated with line-type information;

(e) developing the images on the two image sectors; and (f) transferring the developed images from respective image frames in register onto the same surface of a sheet to form the reproduction.

3. The method according to claim 2 wherien in step (d) the line-type information is stored as signals electronically and exposed on the second image sector using light modulated in response to such signals and wherein the photoconductor is a bipolar photoconductor and one image sector receives a primary charge of one polarity and a second image sector receives a primary charge of a second polarity opposite to the first.

4. A method for electrophotographically producing a reproduction having a composite image of screened image areas of pictorial information and unscreened areas of line-type information, the method comprising;

(a) uniformly electrostatically charging each of two photoconductor image sectors;

(b) forming on one image sector an electrostatic screened image of pictorial information by exposing the one image sector to light from an exposure of an original having the pictorial information as an unscreened continuous tone image and having the line-type information to be reproduced;

(c) erasing background areas of the said one image sector which border the pictorial information exposure, to reduce the charge in the background areas to a level below which will permit development so that no development on the image sector can occur except for the area(s) to be used to reproduce the pictorial information;

(d) forming on the second image sector an electrostatic unscreened image of line-type information by exposing the second image sector to light from an exposure of the same original;

(e) erasing areas of the said second image sector corresponding to the pictorial information to reduce the charge on such areas to a level below which will permit development so that no development on this image sector can occur except for the background areas to be used to reproduce the line-type information;

(f) developing the images on the two image sectors; and (g) transferring the developed images from respective image frames in register onto the same surface of a copy sheet to form the reproduction.

5. A method for electrophotographically producing a reproduction having a composite image of image areas of screened information and image areas of information that are not to be screened during the producing of the reproduction the method comprising the steps of:

(a) forming on one primary charged image sector of a photoconductor an electrostatic image of information by exposure of the image sector to illumination from an entire original document sheet having both information to be screened and information that is not to be screened during the producing of the reproduction;

(b) illuminating a halftone screen pattern on the image sector;

(c) erasing areas of the said one image sector which border the information to be screened by illuminating the image sector with illumination that has not been reflected from the original document sheet to reduce the charge in the areas of the image sector other than those including the information to be screened to a level below which will permit development;

(d) forming on another primary charged image sector an electrostatic image of information by exposure of the another image sector to illumination from the entire same original document sheet;

(e) erasing areas on the said another image sector corresponding to the areas of information to be screened on the said one image sector to reduce the charge on said areas on the said another image sector to a level below which will permit development;

(f) developing the electrostatic images on the two image sectors; and (g) transferring the developed toner images from respective image frames in register onto the same surface of a copy sheet to form the reproduction.

6. The method of claim 5 and wherein in step (b) the screen pattern is illuminated on the image sector by illuminating a screen that is formed integral with the photoconductor.

7. The method of claim 6 and wherein in step (f) both image sectors are developed with opaque materials of the same color.

8. The method of claim 6 and including the step of providing signals relative to the location of the image areas of the original document sheet which are to be screened.

9. The method of claim 8 and including the steps of (c) and (e) the signals are used to illuminate a series of lamps selectively to erase charge from the respective areas to be erased.

10. The method of claim 5 and wherein in step (f) both image sectors are developed with opaque materials of the same color.

11. The method of claim 5 and wherein in step (b) the exposures of each image are made with different levels of illumination.

12. The method of claim 5 and including the step of providing signals relative to the location of the image areas of the original document sheet which are to be screened.

13. The method of claim 12 and wherein in steps (c) and (e) the signals are used to illuminate a series of lamps selectively to erase charge from the respective areas to be erased.

14. The method of claim 5 and wherein each of the exposures of the original document sheet are reflection exposures.

15. A method for electrophotographically producing a reproduction having a composite image of multicolored image areas of screened pictorial information and unscreened areas of line-type information, the method comprising:

(a) uniformly electrostatically charging each of four or more photoconductor image sectors;

(b) forming on at least three of the image sectors an electrostatic screened image of pictorial information by exposing the at least three image sectors to light from an exposure of an original having the pictorial information as an unscreened continuous tone image;

(c) erasing background areas of the said at least three image sectors which border the pictorial information exposure, using means separate from that used in step (b), to reduce the charge in the background areas to a level below which will permit development;

(d) forming on one or more other image sectors that are different from the said at least three image sectors an electrostatic unscreened image(s) of line-type information by exposing the said one or more other image sectors to light modulated with line-type information;

(e) developing hhe images on the four or more image sectors with toners of desired colors;

(f) transferring the developed toner images from respective image frames in register onto the same surface of a copy sheet.

16. The method of claim 15 and wherein in steps (b) and (d) the same original is used and includes both the pictorial and line-type information.

17. The method of claim 16 and including the step of erasing areas of the said one or more other image sectors corresponding to the pictorial information to reduce the charge in such areas to a level below wich will permit development so that no development in the image sector can occur except for the background areas to be used to reproduce the line-type information.

18. The method of claim 17 wherein the original is a document sheet.

19. The method of claim 18 and including the step of providing signals relative to the location of the image areas of the original document sheet which are to be screened.

20. The method of claim 19 and wherein in steps (c) and (e) the signals are used to illuminate a series of lamps selectively to erase charge from respective areas to be erased.

21. The method of claim 17 and wherein in step (b) a screen pattern is illuminated on the image sectors by illuminating a screen that is formed integral with the photoconductor.

22. A method for electrophotographically producing a reproduction having a composite image of multicolored image areas of screened information and image areas of information that are not to be screened during the producing of the reproduction the method comprising the steps of;

(a) forming on at least three primary charged image sectors of a photoconductor an electrostatic image of information by exposure of the image sector to illumination from an entire original document sheet having both information to be screened and information that is not to be screened during the producing of the reproduction;

(b) illuminating a halftone screen pattern on at least three image sectors;

(c) erasing areas of the said at least three image sectors which border the information to be screened by illuminating the at least three image sectors with illumination that has not been reflected from or transmitted through the original document sheet to reduce the charge in the areas of the at least three image sectors, other than those including the information to be screened to a level below which will permit development;

(d) forming on one or more other primary charged image sectors electrostatic image(s) of information by exposure of the one or more other image sectors to illumination from the entire same original document sheet;

(e) erasing areas on the said one or more other image sectors corresponding to the areas of information to be screened on the said at least three image sectors to reduce the charge on said areas on the said one or more other image sectors to a level below which will permit development;

(f) developing the electrostatic images on the image sectors referred to in both steps (a) and (d) with toners of desired colors; and (g) transferring the developed toner images from respective image frames in register onto the same surface of a copy sheet to form the reproduction.

23. Apparatus for electrophotographically producing a reproduction having a composite image of screened image areas of pictorial information and unscreened areas of line-type information, the apparatus comprising:

(a) means for uniformly electrostatically charging each of two photoconductor image sectors;

(b) means for forming on one image sector an electrostatically screened image of pictorial information by exposing the one image sector to light from a reflection exposure of an original having the pictorial information as an unscreened continuous tone image and forming on the second image sector an electrostatic unscreened image of line-type information by reflection exposure of an original having line-type information;

(c) means for erasing background areas of the said one image sector which border the pictorial information exposure reducing the charge in the background areas to a level below which will permit development;

(d) means for developing the images on the two-image sectors with toner; and (e) means for transferring the developed toner images from respective image sectors in register onto a copy sheet.

24. The apparatus of claim 23 and wherein the means for forming (d) comprises a platen for supporting a single document sheet for exposure of the entire document sheet onto each of the two photoconductor image sectors.

25. The apparatus of claim 24 and wherein the erasing means further comprises a means for erasing areas of the said second image sector corresponding to the pictorial information to reduce the charge in such areas to a level below which will permit development so that no development in this image sector can occur except for the background areas to be used to reproduce line-type information.

26. The apparatus of claim 25 and wherein the means for forming in (b) further comprises means for illuminating a screened pattern upon the photo-conductor with illumination that is not modulated by imaging information from the original.

27. The apparatus of claim 26 and wherein the developing means develops both image sectors with toner of the same color.

28. The apparatus of claim 25 and including means for providing signals relative to the location of the image areas of the original document sheet which are to be screened.

29. The apparatus of claim 28 and wherein the erasing means is responsive to said signals and comprises an illumination means for selectively illuminating the photoconductor image sectors to erase charge from the respective areas to be erased.

30. A method for electrophotographically producing a reproduction having an image in a desired color from an image of an original of a different color, the method comprising;

providing an electrostatic primary charge to each of at least two image sectors on a photoconductor;

exposing both of the charged image sectors to the image of the original;

exposing at least two charged image sectors through respective color separation filters to a swatch of the color to be reproduced, the swatch being separate from the original image but its exposure being in the same position in each of the at least two image sectors as the exposures of the original image;

developing the elcctrostatic image formed on each of the at least two image sectors with a differently colored toner; and transferring the developed images in register onto the same surface of a copy sheet with the differently colored toners combining to form the reproduction in a different color from that of the original and from that of the toners used in forming the reproduction.

31. The method of claim 30 and wherein the swatch is exposed onto the photoconductor through a screen.

32. The method according to the claim 30 and including the step of locating the original image on a first exposure platen and locating the swatch of color on a second exposure platen.

33. A method for electrophotographically producing a reproduction having an image in a desired color; the method comprising:

(a) providing an electrostatic primary charge to each of at least two image sectors on a photoconductor;

(b) modulating the charge on the image sectors with image information related to the image to be reproduced;

(c) exposing the image sectors to illumination from a swatch of the color to be reproduced, the swatch being illuminated separately from the image information, to modulate the charge on the image sectors in accordance with the color content of the swatch;

(d) developing the electrostatic images formed on the image sectors with differently colored toners; and (e) transferring the developed images in register onto the same surface of a support with the differently colored toners combining to form the reproduction in a different color from that of the toners used in forming the reproduction.

34. The method of claim 33 and wherein the electrostatic image on the image sectors comprises an image that has been modulated by a screen.

35. A method for electrophotographically producing a reproduction having a composite image of screened pictorial information and areas of line-type information, the method comprising:

(a) providing an electrostatic primary charge on each of at least two image sectors of a photoconductor;

(b) supporting on a first platen a first original containing the pictorial information to be reproduced;

(c) supporting on a second platen a second opaque original containing a mask and the line-type information to be reproduced;

(d) exposing the first original to at least two image sectors through respective color separation filters and a halftone screen;

(e) exposing the second original to a least two image sectors at least one of whose sectors is common to the aforesaid sectors;

(f) providing signals relative to the location of the line-type information relative to a reference on the second original and using these signals to erase the electrostatic image of the line-type information from at least one image sector;

(g) developing the electrostatic images formed on the image sectors with differently colored toners; and (h) transferring the developed images in register onto the same surface of a support to provide a reproduction having screened pictorial information and areas of line-type information.

36. The method of claim 35 wherein the first original includes a swatch of color and the second original includes information to be reproduced in the color of the swatch and wherein the information is reproduced in the color of the swatch.

37. The method of claim 36 and including the step of providing signals relative to the location of the information to be reproduced in the color of the swatch relative to the reference and for using said signals to erase the electrostatic image of this information from at least one image sector.

38. Apparatus for electrophotographically reproducing a composite reproduction, the apparatus comprising:

(a) a photoconductive member;

(b) means including a first exposure platen for exposing an original onto at least two image sectors on the photoconductive member through a halftone screen and color separation filters;

(c) means including a second exposure platen for exposing a second original onto two image sectors of the photoconductive member, at least one of whose sectors is common to the aforesaid sectors;

(d) means for providing signals relative to the position of area(s) of information in one of said originals relative to a reference and for using the signals to erase charge in areas of an image sector not desired to be reproduced;

(e) means for developing the electrostatic images formed on the image sectors with differently colored toners; and (f) means for transferring the developed images in register onto the surface of a copy sheet.

39. A method for electrophotoraphically reproducing an original so that the reproduction is provided with spot coloring comprising:

(a) placing the orginal on an exposure platen of an electrophotographic reproduction apparatus with an image surface thereof facing away form the platen;

(b) placing a handholdable wand on or near points of the document while supported on said exposure platen in (a) to generate signals and using said signals to identify the location of said points relative to a reference associated with said apparatus;

(c) exposing the document while on the exposure platen, with said image surface now facing toward said platen and said original registered to said reference, to more than one image sector on a primary charged photoconductor of the apparatus to form electrostatic images;

(d) selectively erasing charge from at least one image sector in response to the signals generated in step (b);

(e) developing the electrostatic images on the image sectors with toner of different colors; and (f) transferring the developed images in register onto a copy sheet.

40. Apparatus for electrophotographically reproducing an original with a different composition from that of the original, comprising:

(a) an exposure platen for supporting the orginal;

(b) digitizing means for determining locations of certain points or areas on said original relative to a reference on said apparatus and for generating signals in response thereto, said digitizing means using sonic signals for use in determining said locations while said original is supported on said platen with its image surface facing away from the platen;

(c) image forming means for supporting an electrostatic image;

(d) means for exposing said original while supported on said platen with its image surface facing toward the platen to form an electrostatic image upon the image forming means;

(e) means for altering electrostatic charge on said image forming means in response to signals generated by said digitizing means; and (f) means for developing and transferring the electrostatic image to a storage medium.

41. The apparatus of claim 40 and wherein the digitizing means includes means for generating signals relative to the size of the original.

42. The apparatus of claim 40 and wherein said image forming means is adapted to support more than one image sector, temporally or spacially separated;

said means for exposing exposes image of said original onto said more than one image sectors; and said means in paragraph (e) alters electrostatic charge on said more than one image sectors.

43. The apparatus of claim 42 and wherein the means for developing, develops the image sectors each with a different color.

44. Apparatus for electrophotographically reproducing an original with a different composition from that of the original, comprising:

(a) an exposure platen means for supporting the original with its image surface facing away from the platen;

(b) digitizing means for determining locations of certain points or areas on said original and for generating signals in response thereto, said digitizing means using signals generated in response to applying pressure to a point on said original for use in determining said locations while said original is supported on said platen with its image surface facing away from the platen;

(c) image forming means for forming an electrostatic image;

(d) means for exposing said original while supported on said platen with its image surface facing toward the platen to form an electrostatic image upon the image forming means;

(e) means for altering electrostatic charge on said image forming means in response to signals generated by said digitizing means; and (f) means for developing and transferring the electrostatic image to a storage medium.

45. The apparatus of claim 44 and wherein the digitizing means includes means for generating signals relative to the size of the original.

46. The apparatus of claim 44 and wherein said support means is adapted to image forming more than one image sector, temporally or spacially separated;

said means for exposing exposes an image of said original onto said more than one image sectors;

said means in paragraph (e) alters electrostatic charge on said more than one image sectors.

47. The apparatus of claim 46, and wherein the means for developing, develops the image sectors each with a different color.

48. A method for electrophotographically reproducing an original so that the reproduction is provided with an alteration of the original comprising:

(a) placing the original on an exposure platen of an electrophotographic reproduction apparatus with an image surface thereof facing away from the platen;

(b) placing a handholdable wand on or near points of the document while supported on said exposure platen in (a) to generate signals and using said signals to identify the location of said points relative to a reference associated with said apparatus;

(c) exposing the document while on the exposure platen, with said image surface now facing toward said platen and said original registered to said reference to at least one image sector on a primary charged photoconductor of the apparatus to form an electrostatic image;

(d) selectively modifying charge on the at least one image sector in response to the signals generated in step (b);

(e) developing the electrostatic image on the image sector with toner; and (f) transferring the developed image in register onto a copy sheet.

49. Apparatus for electrophotographically producing copy having a composite image of information, the apparatus comprising:

(a) means for supporting an original document;

(b) digitizing means for determining operator selectable locations of certain points or areas on said original document relative to a reference on said apparatus and for generating signals in response, thereto;

(c) first and second image frame means for supporting electrostatic images on each of said image frames;

(d) means for exposing said original with light and imaging light modulated by information on said original upon one of said image frame means to form an electrostatic image;

(e) charge altering means for altering electrostatic charge on said one image frame in response to said signals;

(f) means for generating electronic signals containing character information;

(g) means activating said charge altering means in response to said electronic signals containing character information to establish an electrostatic charge on the other of said image frames for reproducing said character information;

(h) means for developing and transferring the electrostatic images formed on said first and second image frames to storage medium to form a composite image.

50. The apparatus of claim 49 and wherein the charge altering means is a light source means for exposing the first and second image frames.

51. The apparatus of claim 49 and wherein the first and second image frame means comprises a bipolar photoconductor; and further including means for establishing a uniform primary charge of one polarity on one of said image frames and a uniform primary charge of a second polarity opposite of said one polarity on the second image frame.

52. The apparatus of claim 49 and wherein the charge altering means in response to said digitizing means prevents reproduction of portions of image information on said original document.

53. Reproduction apparatus comprising:

(a) means for supporting an original document;

(b) digitizing means for determining selectable locations of certain points or areas on said original document relative to a reference on said apparatus and for generating signals in response, thereto;

(c) first and second image frame means for supporting electrostatic images on each of said image frames;

(d) means for exposing said original while supported on said platen to form an electrostatic image upon one of said image frame means;

(e) cahrge altering means for altering electrostatic charge on said one image frame in response to said signals to alter the information reproduced on said one image frame;

(f) means for generating electronic signals containing character information;

(g) means activating said charge altering means in response to said electronic signals containing character information to establish an electrostatic charge on the other of said image frames for reproducing said character information;

(h) means for developing and transferring the electrostatic images formed on said first and second image frames to form visible images of the information reproduced from said document and the information reproduced from said electronic originals containing character information.

54. The apparatus of claim 53, and wherein the charge altering means is a light source means for exposing the first and second image frames.

55. The apparatus of claim 53 and wherein the first and second image frames means comprises a bipolar photoconductor; and further including means for establishing a uniform primary charge of one polarity on one of said image frames and a uniform primary charge of a second polarity opposite of said one polarity on the second image frame.

56. The apparatus of claim 53 and wherein the change altering means in response to said digitizing means prevents reproduction of portions of image information on said original document.

* * * * *